US007041628B2

(12) United States Patent
Sunder et al.

(10) Patent No.: US 7,041,628 B2
(45) **Date of Patent: *May 9, 2006**

(54) AQUEOUS 3 IN 1 DISHWASHER PRODUCTS

(75) Inventors: Matthias Sunder, Bourron-Marlotte (FR); Rolf Bayersdoerfer, Duesseldorf (DE); Christian Nitsch, Duesseldorf (DE); Bernd Richter, Leichlingen (DE); Arnd Kessler, Leverkusen (DE); Michael Dreja, Cologne (DE); Sven Mueller, Duisburg (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/753,130

(22) Filed: Jan. 7, 2004

(65) Prior Publication Data

US 2004/0167048 A1 Aug. 26, 2004

Related U.S. Application Data

(63) Continuation of application No. PCT/EP02/07139, filed on Jun. 28, 2002.

(30) Foreign Application Priority Data

Jul. 7, 2001 (DE) ..... 101 33 137
Oct. 30, 2001 (DE) ..... 101 53 554

(51) Int. Cl.
*C11D 1/66* (2006.01)
*C11D 3/06* (2006.01)
*C11D 3/34* (2006.01)
*C11D 3/37* (2006.01)
*C11D 3/43* (2006.01)

(52) U.S. Cl. ..... 510/223; 510/224; 510/226; 510/228; 510/230; 510/231; 510/232; 510/439; 510/475; 510/476; 510/533

(58) Field of Classification Search ..... 510/223, 510/224, 226, 228, 230, 231, 232, 439, 475, 510/476, 533
See application file for complete search history.

(56) References Cited

U.S. PATENT DOCUMENTS

| | | | |
|---|---|---|---|
| 3,720,621 | A | 3/1973 | Smeets |
| 5,082,578 | A | 1/1992 | Langer et al. |
| 5,413,727 | A | 5/1995 | Drapier et al. |
| 5,691,292 | A | 11/1997 | Marshall et al. |
| 6,207,780 | B1 | 3/2001 | Stockhausen et al. |

FOREIGN PATENT DOCUMENTS

| | | | |
|---|---|---|---|
| DE | 20 29 598 | | 12/1970 |
| DE | 37 43 739 | A1 | 7/1989 |
| DE | 195 16 957 | A1 | 11/1996 |
| EP | 0 439 878 | A1 | 8/1991 |
| EP | 0 446 761 | A1 | 9/1991 |
| EP | 0 530 635 | A2 | 3/1993 |
| EP | 0 611 206 | A2 | 8/1994 |
| EP | 0 712 810 | A2 | 5/1996 |
| EP | 0 851 022 | A2 | 7/1998 |
| EP | 851022 | * | 7/1998 |
| WO | WO 93/21299 | A1 | 10/1993 |
| WO | WO 01/72941 | A1 | 10/2001 |
| WO | WO 02/16205 | A1 | 2/2002 |
| WO | WO 02/20708 | A1 | 3/2002 |
| WO | WO 02/42408 | A2 | 5/2002 |

OTHER PUBLICATIONS

Rompp Chemie Lexikon, Georg Thieme Verlag Stuttgart/New York, 9th Edition, p. 3168 (1991), not translated; no month given.

* cited by examiner

*Primary Examiner*—Brian P. Mruk
(74) *Attorney, Agent, or Firm*—Glenn E. J. Murphy

(57) ABSTRACT

Liquid aqueous machine dishwasher products comprising
a) 20 to 50% by weight of one or more water-soluble builder(s),
b) 0.1 to 70% by weight of copolymers of
i) unsaturated carboxylic acids
ii) monomers containing sulfonic acid groups
iii) optionally further ionic or nonionogenic monomers
c) 5 to 30% by weight of nonionic surfactant(s).
Also, the composition packaged in portions in a water-soluble enclosure.

60 Claims, No Drawings

AQUEOUS 3 IN 1 DISHWASHER PRODUCTS

CROSS REFERENCE TO RELATED APPLICATIONS

This application is a continuation under 35 U.S.C. § 365(c) and 35 USC § 120 of international application PCT/EP02/07139, filed on Jun. 28, 2002, claiming priority under 35 USC § 119 of DE 101 33 137.1, filed Jul. 7, 2001 and DE 101 53 554.6, filed Oct. 30, 2001, each of which is incorporated herein by reference in its entirety.

BACKGROUND OF THE INVENTION

The present invention relates to liquid products for washing dishes in a customary domestic dishwashing machine. In particular, the invention relates to water-based liquid dishwashing products for machine dishwashing.

Machine dishwasher products for household use are usually supplied in the form of powders or more recently also in the form of shaped bodies (tablets). The supply form of a liquid in this sector has hitherto only achieved minor importance on the market. Compared with the solid supply forms, liquids do, however, have advantages with regard to dosing and esthetic product advantages which should not be underestimated, which make this supply form of interest. For example, there is already broad prior art both with regard to nonaqueous, for the most part solvent-based, but also with regard to aqueous dishwashing products for washing dishes in a customary domestic dishwashing machine.

For example, DE 20 29 598 describes liquid cleaning compositions which comprise 14 to 35% by weight of sodium tripolyphosphate, 0.1 to 50% by weight of a potassium and/or ammonium salt of an inorganic or organic acid, water, and optionally surfactants, solubility promoters, sequestrants, persalts and other ingredients.

Linear-viscoelastic cleaning compositions for machine dishwashing are also described in European patent application EP 446 761 (Colgate). The compositions disclosed here comprise up to 2% by weight of a long-chain fatty acid or a salt thereof, 0.1 to 5% by weight of surfactant, 5 to 40% by weight of water-soluble builders, and up to 20% by weight of chlorine bleaches and a polycarboxylate thickener, where the ratio of potassium ions to sodium ions in these compositions should be 1:1 to 45:1.

Machine dishwasher products in the form of clear, transparent gels are disclosed in European patent application EP 439 878 (Union Camp Corp.). The compositions described therein comprise a polyacrylate thickener, which forms a gel matrix with water, surfactant, bleach, a builder and water.

Machine dishwasher products in the form of gels are also described in European patent application EP 611 206 (Colgate). These compositions comprise 1 to 12% by weight of a liquid nonionic surfactant, 2 to 70% by weight of builders, and enzymes and a stabilization system which is composed of swelling substances and hydroxypropylcellulose.

Viscoelastic, thixotropic dishwashing products comprising 0.001 to 5% by weight of surfactant, and enzymes and an enzyme stabilization system of boric acid and polyhydroxy compounds are described in international patent application WO 93/21299 (Procter & Gamble). The products disclosed therein likewise comprise 0.1 to 10% by weight of one or more thickeners.

Dishes washed by machine are nowadays often subject to higher requirements than dishes washed manually. For example, even dishes which have been completely cleaned of food residues will not be evaluated as being perfect if, after machine dishwashing, they still have whitish marks based on water hardness or other mineral salts which, due to a lack of wetting agents, originate from dried-on water drops.

In order to obtain sparkling and stainfree dishes, rinse aids are therefore nowadays used with success. The addition of rinse aid at the end of the wash program ensures that the water runs off from the ware as completely as possible, so that the various surfaces are residue-free and sparkling at the end of the wash program, Machine dishwashing in domestic dishwashing machines usually includes a prewash cycle, a main wash cycle and a clear-rinse cycle, which are interrupted by intermediate rinse cycles, With most machines, the prewash cycle for heavily soiled dishes can be selected, but is only chosen by the consumer in exceptional cases, meaning that in most machines a main wash cycle, an intermediate rinse cycle with clean water and a clear-rinse cycle are carried out. The temperature of the main wash cycle varies between 40 and 65° C. depending on the type of machine and program choice. In the clear-rinse cycle, rinse aids are added from a dosing chamber in the machine; these usually comprise nonionic surfactants as the main constituent. Such rinse aids are in liquid form and are described widely in the prior art. Their function is primarily to prevent limescale marks and deposits on the washed dishes.

These so-called "2 in 1" products lead to simplified handling and remove the burden from the consumer of the additional dosing of two different products (detergent and rinse aid). Nevertheless, to operate a domestic dishwashing machine, two dosing operations are periodically required since the regeneration salt must be topped up in the water softening system of the machine after a certain number of wash operations. These water softening systems consist of ion exchanger polymers which soften the hard water flowing into the machine and, after the wash program, are regenerated by rinsing with salt water.

Products which, in the form of so-called "3 in 1" products, combine the conventional detergents, rinse aids and a salt replacement function have recently been described in the prior art. These products are, however, only available as solids (tablets).

The object of the present invention was then to provide a product which is pourable and can thus be readily and freely dosable in terms of amounts and which only has to be dosed once per use without the dosing of another product and thus a duplicate dosing operation being necessary even after a relatively high number of wash cycles. The aim was to provide a liquid to gel-like product which, in addition to the "incorporated rinse aid", renders it unnecessary to top up the regeneration salt container and thus further simplifies handling, In this connection, the performance of the product was to reach or exceed the level of performance of conventional three-component product dosings (salt-detergent-rinse aid) or of new types of two-component product dosings ("2 in 1" detergent-rinse aids). In this connection, the products to be provided should be superior to conventional products with regard to as many properties as possible. In particular, the dichotomy which arises in the case of many pourable products—advantages with certain properties (flowability, ability to be removed completely, pleasing product appearance etc.) are accompanied by disadvantages with other properties (settling behavior, storage stability, performance etc.)—should be overcome. The object was therefore also to provide products which combine advantageous rheological properties (flowability, ability of the remainder to be removed etc.), advantageous product characteristics (appearance, cleaning power, storage stability etc.) and a production which can be realized industrially without problems and can be carried out in a cost-effective manner.

It has now been found that pourable machine dishwasher products with the abovementioned positive properties can be formulated on the basis of water as solvent if these products comprise certain polymers containing sulfonic acid groups, and nonionic surfactants.

DESCRIPTION OF THE INVENTION

The present invention therefore provides, in a first embodiment, liquid aqueous machine dishwasher products comprising a) 20 to 50% by weight of one or more water-soluble builder(s), b) 0.1 to 70% by weight of copolymers of i) unsaturated carboxylic acids ii) monomers containing sulfonic acid groups iii) optionally further ionic or nonionogenic monomers c) 5 to 30% by weight of nonionic surfactant(s).

As ingredient a), the products according to the invention comprise one or more water-soluble builders. Water-soluble builders are used in the compositions according to the invention primarily to bind calcium and magnesium. Customary builders which are present for the purposes of the invention preferably in amounts of from 22.5 to 45% by weight, preferably from 25 to 40% by weight and in particular from 27.5 to 35% by weight, in each case based on the total product, are the low molecular weight polycarboxylic acids and their salts, the homopolymeric and copolymeric polycarboxylic acids and their salts, the carbonates, phosphates and sodium and potassium silicates. For the cleaning compositions according to the invention, preference is given to using trisodium citrate and/or pentasodium tripolyphosphate and silicatic builders from the class of alkali metal disilicates. In general, with the alkali metal salts, the potassium salts are preferred over the sodium salts since they often have a greater solubility in water. Preferred water-soluble builders are, for example, tripotassium citrate, potassium carbonate and the potassium waterglasses, Particularly preferred machine dishwasher products comprise, as builders, phosphates, preferably alkali metal phosphates, particularly preferably pentasodium or pentapotassium triphosphate (sodium or potassium tripolyphosphate)

Alkali metal phosphates is the collective term for the alkali metal (in particular sodium and potassium) salts of the various phosphoric acids, among which metaphosphoric acids $(HPO_3)_n$ and orthophosphoric acid $H_3PO_4$, in addition to higher molecular weight representatives, may be differentiated. The phosphates combine a number of advantages: they act as alkali carriers, prevent limescale deposits and additionally contribute to the cleaning performance.

Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water, which lose the water of crystallization upon heating and undergo conversion at 200° C. into the weakly acidic diphosphate (disodium hydrogendiphosphate, $Na_2H_2P_2O_7$), at a higher temperature into sodium trimetaphosphate ($Na_3P_3O_9$) and Maddrell's salt (see below). $NaH_2PO_4$ is acidic; it is formed if phosphoric acid is adjusted to a pH of 4.5 using sodium hydroxide solution and the slurry is sprayed. Potassium dihydrogenphosphate (primary or monobasic potassium phosphate, potassium biphosphate, PDP), $KH_2PO_4$, is a white salt of density 2.33 $gcm^{-3}$, has a melting point of 253° [decomposition with the formation of potassium polyphosphate $(KPO_3)_x$] and is readily soluble in water.

Disodium hydrogenphosphate (secondary sodium phosphate), $Na_2HPO_4$, is a colorless, very readily water-soluble crystalline salt. It exists in anhydrous form and with 2 mol of water (density 2.066 $gcm^{-3}$, water loss at 950), 7 mol of water (density 1.68 $gcm^{-3}$, melting point 48° with loss of $5H_2O$) and 12 mol of water (density 1.52 $gcm^{-3}$, melting point 35° with loss of $5H_2O$), becomes anhydrous at 100° and converts to the diphosphate $Na_4P_2O_7$ upon more severe heating. Disodium hydrogenphosphate is prepared by neutralizing phosphoric acid with soda solution using phenolphthalein as indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, are colorless crystals which as the dodecahydrate have a density of 1.62 $gcm^{-3}$ and a melting point of 73–76° C. (decomposition), as the decahydrate (corresponding to 19–20% of $P_2O_5$) have a melting point of 100° C. and in anhydrous form (corresponding to 39–40% of $P_2O_5$) have a density of 2.536 $gcm^{-3}$. Trisodium phosphate is readily soluble in water with an alkaline reaction and is prepared by evaporative concentration of a solution of exactly 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1340° and is readily soluble in water with an alkaline reaction. It is produced, for example, when Thomas slag is heated with charcoal and potassium sulfate. Despite the relatively high price, the more readily soluble and therefore highly effective potassium phosphates are often preferred in the cleaners industry over corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and as the decahydrate (density 1.815–1.836 $gcm^{-3}$, melting point 94° with loss of water). For substances are colorless crystals which are soluble in water with an alkaline reaction. $Na_4P_2O_7$ is formed when disodium phosphate is heated at >200° or by reacting phosphoric acid with soda in the stoichiometric ratio and dewatering the solution by spraying. The decahydrate complexes heavy metal salts and water hardness constituents and therefore reduces the hardness of the water. Potassium diphosphate (potassium pyrophosphate), $K_4P_2O_7$, exists in the form of the trihydrate and is a colorless, hygroscopic powder with a density of 2.33 $gcm^{-3}$ which is soluble in water, the pH of the 1% strength solution at 25° being 10.4.

Condensation of the $NaH_2PO_4$ or of the $KH_2PO_4$ gives rise to higher molecular weight sodium and potassium phosphates, among which it is possible to differentiate between cyclic representatives, the sodium and potassium metaphosphates, and catenated types, the sodium and potassium polyphosphates. For the latter, in particular, a large number of names are in use: fused or high-temperature phosphates, Graham's salt, Kurrol's and Maddrell's salt. All higher sodium and potassium phosphates are referred to collectively as condensed phosphates.

The industrially important pentasodium triphosphate, $Na_3P_3O_{10}$ (sodium tripolyphosphate), is a nonhygroscopic, white, water-soluble salt which is anhydrous or crystallizes with 6 $H_2O$ and has the general formula NaO—[P(O)(ONa)—O]$_n$—Na where n=3. About 17 g of the salt free from water of crystallization dissolve in 100 g of water at room temperature, about 20 g dissolve at 60° C., and about 32 g dissolve at 100°; after heating the solution for 2 hours at 100°, about 8% orthophosphate and 15% diphosphate are produced by hydrolysis. In the case of the preparation of pentasodium triphosphate, phosphoric acid is reacted with soda solution or sodium hydroxide solution in the stoichiometric ratio and the solution is dewatered by spraying. Similarly to Graham's salt and sodium diphosphate, pentasodium triphosphate dissolves many insoluble metal compounds (including lime soaps, etc.). Pentapotassium triphosphate, $K_5P_3O_{10}$ (potassium triphosphate), is commercially available, for example, in the form of a 50% strength by weight solution (>23% $P_2O_5$, 25% $K_2O$). The potassium polyphosphates are widely used in the detergents and cleaners industry.

The products according to the invention can particularly advantageously comprise condensed phosphates as water-softening substances. These substances form a group of phosphates—due to their preparation also called fused or high-temperature phosphates—which can be derived from acidic salts of orthophosphoric acid (phosphoric acids) by condensation. The condensed phosphates can be divided into the metaphosphates $[Mln(PO_3)_n]$ and polyphosphates ($M^1_{n+2}P_nO_{3n+1}$ or $M^1_nH_2P_nO_{3n+1}$).

The term "metaphosphates" was originally the general name for condensed phosphates with the composition $M_n[P_nO_{3n}]$ (M=monovalent metal), but is nowadays mostly restricted to salts with ring-shaped cyclo(poly)phosphate anions. When n=3, 4, 5, 6 etc. the names are tri-, tetra-, penta-, hexametaphosphates, etc. According to the systematic nomenclature of the isopolyanions, the anion where n=3 is, for example, referred to as cyclotriphosphate.

Metaphosphates are obtained as accompanying substances of the Graham salt—incorrectly referred to as sodium hexametaphosphate—by melting $NaH_2PO_4$ at temperatures exceeding 620° C., where so-called Maddrell's salt is also formed as an intermediate. This salt and Kurrol's salt are linear polyphosphates which are mostly nowadays not included with the metaphosphates, but which can likewise be used advantageously as water-softening substances for the purposes of the present invention.

The crystalline, water-insoluble Maddrell's salt, $(NaPO_3)_x$, where x is >1000, which can be obtained at 200–300° C. from $NaH_2PO_4$, converts, at about 600° C., into the cyclic metaphosphate $[Na_3(PO_3)_3]$, which melts at 620° C. The quenched, glass-like melt is, depending on the reaction conditions, the water-soluble Graham's salt $(NaPO_3)_{40-50}$, or a glass-like condensed phosphate of the composition $(NaPO_3)_{15-20}$, which is known as Calgon. For both products, the erroneous name hexametaphosphates is still in use, The so-called Kurrol's salt, $(NaPO_3)_n$, where n is >>5000, likewise arises from the 600° C.-hot melt of the Maddrell's salt if this is left for a short time at about 500° C. It forms highly polymeric water-soluble fibers.

The "hexametaphosphates" Budit® H6 and H8 from Budenheim have proven particularly preferred water-softening substances from the classes of condensed phosphates specified above.

As second constituent b), the products according to the invention comprise copolymers of unsaturated carboxylic acids, monomers containing sulfonic acid groups and optionally further ionic or nonionogenic monomers. These copolymers mean that the parts of dishes treated with such products become significantly cleaner during subsequent washing operations than parts of dishes which have been washed with conventional products.

An additional positive effect is the shortening of the drying time of the parts of dishes treated with the cleaning composition, i.e. the consumer can take the dishes from the machine earlier and reuse them after the wash program is finished.

The invention is notable for improved "cleanability" of the treated substrates during later washing operations and for a considerable shortening of the drying time compared with comparable products without the use of polymers containing sulfonic acid groups.

For the purposes of the teaching according to the invention, drying time is generally understood as having the literal meaning, i.e. the time which elapses until a surface of the dishes treated in a dishwasher machine has dried, but in particular which elapses until 90% of a surface treated with a cleaning composition or rinse aid in concentrated or dilute form has dried.

For the purposes of the present invention, unsaturated carboxylic acids of the formula I are preferred as monomer, $$R^1(R^2)C{=}C(R^3)COOH \quad (I),$$

in which $R^1$ to $R^3$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms.

Among the unsaturated carboxylic acids which can be described by the formula I, particular preference is given to acrylic acid ($R^1$=$R^2$=$R^3$=H), methacrylic acid ($R^1$=$R^2$=H; $R^3$=$CH_3$) and/or maleic acid ($R^1$=COOH; $R^2$=$R^3$=H).

In the case of the monomers containing sulfonic acid groups, preference is given to those of the formula II, $$R^5(R^6)C{=}C(R^7)—X—SO_3H \quad (II),$$

in which $R^5$ to $R^7$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH2)_k$— where k=1 to 6, —C(O)—NH—C$(CH_3)_2$— and —C(O)—NH—CH($CH_2CH_3$)—.

Among these monomers, preference is given to those of the formulae IIa, IIb and/or IIc, $$H_2C{=}CH—X—SO_3H \quad (IIa),$$

$$H_2C{=}C(CH_3)—X—SO_3H \quad (IIb),$$

$$HO_3S—X—(R^6)C{=}C(R^7)—X—SO_3H \quad (IIc),$$

in which $R^6$ and $R^7$, independently of one another, are chosen from —H, —$CH_3$, —$CH_2CH_3$, —$CH_2CH_2CH_3$, —$CH(CH_3)_2$ and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)—.

Particularly preferred monomers containing sulfonic acid groups here are 1-acrylamido- 1-propanesulfonic acid (X=—C(O)NH—CH($CH_2CH_3$) in formula IIa), 2-acrylamido-2-propanesulfonic acid (X=—C(O)NH—C$(CH_3)_2$ in formula IIa), 2-acrylamido-2-methyl-1-propanesulfonic acid (X=—C(O)NH—CH($CH_3$)$CH_2$— in formula IIa), 2-methacrylamido-2-methyl-1-propanesulfonic acid (X=—C(O)NH—CH($CH_3$)$CH_2$— in formula IIb), 3-methacrylamido-2-hydroxypropanesulfonic acid (X=—C(O)NH—$CH_2$CH(OH)$CH_2$— in formula IIb), allylsulfonic acid (X=$CH_2$ in formula IIa), methallylsulfonic acid (X=$CH_2$ in formula IIb), allyloxybenzenesulfonic acid (X=—$CH_2$—O—$C_6H_4$— in formula IIa), methallyloxybenzenesulfonic acid (X=—$CH_2$—O—$C_6H_4$— in formula IIb), 2-hydroxy-3-(2-propenyloxy)propanesulfonic acid, 2-methyl-2-propene-1-sulfonic acid (X=—$CH_2$ in formula IIb), styrenesulfonic acid (X=—$C_6H_4$ in formula IIa), vinylsulfonic acid (X not present in formula IIa), 3-sulfopropyl acrylate (X=—C(O)NH—$CH_2CH_2CH_2$— in formula IIa), 3-sulfopropyl methacrylate (X=—C(O)NH—$CH_2CH_2CH_2$— in formula IIb), sulfomethacrylamide (X=—C(O)NH— in formula IIb), sulfomethyl methacrylamide (X=—C(O)NH—$CH_2$— in formula IIb) and water-soluble salts of said acids.

Suitable further ionic or nonionogenic monomers are, in particular, ethylenically unsaturated compounds. Preferably the content of the monomers of group iii) in the polymers used according to the invention is less than 20% by weight, based on the polymer. Polymers to be used with particular preference consist merely of monomers of groups i) and ii).

In summary, copolymers of i) unsaturated carboxylic acids of the formula I $$R^1(R^2)C{=}C(R^3)COOH \quad \text{(I)},$$

in which $R^1$ to $R^3$, independently of one another, are —H, —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, ii) monomers of the formula II containing sulfonic acid groups $$R^5(R^6)C{=}C(R^7)—X—SO_3H \quad \text{(II)},$$

in which $R^5$ to $R^7$, independently of one another, are —H, —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH_2)_k$— where k=1 to 6, —C(O)—NH—C($CH_3$)$_2$— and —C(O)—NH—CH($CH_2CH_3$)— iii) optionally further ionic or nonionogenic monomers are particularly preferred.

Particularly preferred copolymers consist of i) one or more unsaturated carboxylic acids from the group consisting of acrylic acid, methacrylic acid and/or maleic acid ii) one or more monomers containing sulfonic acid groups and of the formulae IIa, IIb and/or IIc:

$$H_2C{=}CH—X—SO_3H \quad \text{(IIa)},$$

$$H_2C{=}C(CH_3)—X—SO_3H \quad \text{(IIb)},$$

$$HO_3S—X—(R^6)C{=}C(R^7)—X—SO_3H \quad \text{(IIc)},$$

in which $R^6$ and $R^7$, independently of one another, are chosen from —H, —$CH_3$, —$CH_2CH_3$, —$CH_2CH_2CH_3$, —CH($CH_3$)$_2$ and X is an optionally present spacer group which is chosen from —$(CH_2)_n$—, where n=0 to 4, —COO—$(CH_2)_k$— where k=1 to 6, —C(O)—NH—C($CH_3$)$_2$— and —C(O)—NH—CH($CH_2CH_3$)— iii) optionally further ionic or nonionogenic monomers.

The copolymers present according to the invention in the products can comprise the monomers from groups i) and ii), and optionally iii) in varying amounts, where all of the representatives from group i) can be combined with all of the representatives from group ii) and all of the representatives from group iii) Particularly preferred polymers have certain structural units-which are described below.

Thus, for example, preference is given to products according to the invention which are characterized in that they comprise one or more copolymers which contain structural units of the formula III $$—[CH_2—CHCOOH]_m—[CH_2—CHC(O)—Y—SO_3H]_p— \quad \text{(III)},$$

in which m and p are in each case a whole natural number between 1 and 2000, and Y is a spacer group chosen from substituted or unsubstituted aliphatic, aromatic or araliphatic hydrocarbon radicals having 1 to 24 carbon atoms, where spacer groups in which Y is —O—$(CH_2)_n$— where n=0 to 4, is —O—$(C_6H_4)$—, is —NH—C($CH_3$)$_2$— or —NH—CH($CH_2CH_3$)— are preferred.

These polymers are prepared by copolymerization of acrylic acid with an acrylic acid derivative containing sulfonic acid groups. Copolymerizing the acrylic acid derivative containing sulfonic acid groups with methacrylic acid leads to another polymer which is likewise used with preference in the products according to the invention and is characterized in that the products comprise one or more copolymers which contain structural units of the formula IV $$—[CH_2—C(CH_3)COOH]_m—[CH_2—CHC(O)—Y—SO_3H]_p— \quad \text{(IV)},$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—$(C_6H_4)$—, is —NH—C($CH_3$)$_2$— or —NH—CH($CH_2CH_3$)— are preferred.

Entirely analogously, acrylic acid and/or methacrylic acid can also be copolymerized with methacrylic acid derivatives containing sulfonic acid groups, as a result of which the structural units in the molecule are changed. For example, products according to the invention which comprise one or more copolymers which contain structural units of the formula V $$—[CH_2—CHCOOH]_m—[CH_2—C(CH_3)C(O)—Y—SO_3H]_p— \quad \text{(V)},$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—$(C_6H_4)$—, is —NH—C($CH_3$)$_2$— or —NH—CH($CH_2CH_3$)— are preferred, are likewise a preferred embodiment of the present invention, just as preference is also given to products which are characterized in that they comprise one or more copolymers which contain structural units of the formula VI $$—[CH_2—C(CH_3)COOH]_m—[CH_2—C(CH_3)C(O)—Y—SO_3H]_p— \quad (VI),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In place of acrylic acid and/or methacrylic acid, or in addition thereto, it is also possible to use maleic acid as particularly preferred monomer from group i). This gives products preferred according to the invention which are characterized in that they comprise one or more copolymers which contain structural units of the formula VII $$—[HOOCCH—CHCOOH]_m—[CH_2—CHC(O)—Y—SO_3H]_p— \quad (VII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred, and gives products which are characterized in that they comprise one or more copolymers which contain structural units of the formula VIII $$—[HOOCCH—CHCOOH]_m—[CH_2—C(CH_3)C(O)O—Y—SO_3H]_p— \quad (VIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In summary, machine dishwasher products according to the invention are preferred which comprise, as ingredient b), one or more copolymers which contain structural units of the formulae III and/or IV and/or V and/or VI and/or VII and/or VIII $$—[CH_2—CHCOOH]_m—[CH_2—CHC(O)—Y—SO_3H]_p— \quad (III),$$

$$—[CH_2—C(CH_3)COOH]_m—[CH_2—CHC(O)—Y—SO_3H_p]— \quad (IV),$$

$$—[CH_1—C(CH_2)COOH]_m—[CH_2—C(CH_3)C(O)—Y—SO_3H]_p— \quad (VI),$$

$$—[HOOCCH—CHCOOH]_m—[CH_2—CHC(O)—Y—SO_3H]_p— \quad (VII),$$

$$—[HOOCCH—CHCOOH]_m—[CH_2—C(CH_3)C(O)O—Y—SO_3H]_p— \quad (VIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$ where n=0 to 4, is $—O—(C_6H_4)—$, is $—NH—C(CH_3)_2—$ or $—NH—CH(CH_2CH_3)—$ are preferred, In the polymers, all or some of the sulfonic acid groups can be present in neutralized form, i.e. the acidic hydrogen atom of the sulfonic acid group in some or all sulfonic acid groups can be replaced with metal ions, preferably alkali metal ions and in particular with sodium ions. Corresponding products which are characterized in that the sulfonic acid groups in the copolymer are in partially or completely neutralized form are preferred in accordance with the invention.

The monomer distribution of the copolymers used in the products according to the invention is, in the case of copolymers which comprise only monomers from groups i) and ii), preferably in each case 5 to 95% by weight of i) or ii), particularly preferably 50 to 90% by weight of monomer from group i) and 10 to 50% by weight of monomer from group ii), in each case based on the polymer.

In the case of terpolymers, particular preference is given to those which comprise 20 to 85% by weight of monomer from group i), 10 to 60% by weight of monomer from group ii), and 5 to 30% by weight of monomer from group iii).

The molar mass of the polymers used in the products according to the invention can be varied in order to match the properties of the polymers to the desired intended use. Preferred machine dishwasher products are characterized in that the copolymers have molar masses of from 2000 to 200 000 $gmol^{-1}$, preferably from 4000 to 25 000 $gmol^{-1}$ and in particular from 5000 to 15 000 $gmol^{-1}$.

The content of one or more copolymers in the products according to the invention can vary depending on the intended use and desired product performance, preferred machine dishwasher products according to the invention being characterized in that the copolymer or copolymers is/are present in amounts of from 0.25 to 50% by weight, preferably from 0.5 to 35% by weight, particularly preferably from 0.75 to 20% by weight and in particular from 1 to 15% by weight.

As ingredient c), the products according to the invention comprise one or more nonionic surfactants. The amounts in which the nonionic surfactants are used are, according to the invention, between 5 and 30% by weight, preference being given to machine dishwasher products according to the invention which comprise 5 to 25% by weight, preferably 6 to 22.5% by weight, particularly preferably 7.5 to 20% by weight and in particular 8 to 17.5% by weight, of nonionic surfactant(s).

The nonionic surfactants used are preferably alkoxylated, advantageously ethoxylated, in particular primary, alcohols having preferably 8 to 18 carbon atoms and on average 1 to 12 mol of ethylene oxide (EO) per mole of alcohol, in which the alcohol radical may be linear or preferably methyl-branched in the 2 position, or may contain linear and methyl-branched radicals in the mixture, as are usually present in oxo alcohol radicals. In particular, however, preference is given to alcohol ethoxylates with linear radicals of alcohols of natural origin having 12 to 18 carbon atoms, e.g. from coconut alcohol, palm alcohol, tallow fatty alcohol or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures of these, such as mixtures of $C_{12-14}$-alcohol with 3 EO and $C_{12-18}$-alcohol with 5 EO. The stated degrees of ethoxylation represent statistical average values which, for a specific product, may be an integer or a fraction. Preferred alcohol ethoxylates have a narrowed homolog distribution (narrow range ethoxylates, NRE). In addition to these nonionic surfactants, it is also possible to use fatty alcohols with more than 12 EO. Examples thereof are tallow fatty alcohol with 14 EO, 25 EO, 30 EO or 40 EO.

In addition, further nonionic surfactants which may be used are also alkyl glycosides of the general formula $RO(G)_x$, in which R is a primary straight-chain or methyl-branched, in particular methyl-branched in the 2 position, aliphatic radical having 8 to 22 carbon atoms, preferably 12 to 18 carbon atoms, and G is the symbol which stands for a glycose unit with 5 or 6 carbon atoms, preferably glucose. The degree of oligomerization x, which gives the distribution of monoglycosides and oligoglycosides, is any desired number between 1 and 10; preferably x is 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula (IX)

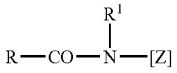

(IX)

in which RCO is an aliphatic acyl radical having 6 to 22 carbon atoms, $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which are customarily obtained by reductive amination of a reducing sugar with ammonia, an alkylamine or an alkanolamine, and subsequent acylation with a fatty acid, a fatty acid alkyl ester or a fatty acid chloride.

The group of polyhydroxy fatty acid amides also includes compounds of the formula (X)

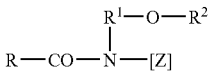

(X)

in which R is a linear or branched alkyl or alkenyl radical having 7 to 12 carbon atoms, $R^1$ is a linear, branched or cyclic alkyl radical or an aryl radical having 2 to 8 carbon atoms, and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, for example glucose, fructose, maltose, lactose, galactose, mannose or xylose. The N-alkoxy- or N-aryloxy-substituted compounds may then be converted into the desired polyhydroxy fatty acid amides by reaction with fatty acid methyl esters in the presence of an alkoxide as catalyst.

The preferred surfactants used are low-foam nonionic surfactants. The machine dishwasher products according to the invention particularly advantageously comprise a nonionic surfactant which has a melting point above room temperature. Consequently, preferred products are characterized in that they comprise nonionic surfactant(s) which has/have a melting point above 20° C., preferably above 25° C., particularly preferably between 25 and 60° C. and in particular between 26.6 and 43.3° C.

Suitable nonionic surfactants which have melting points or softening points within the stated temperature range are, for example, low-foam nonionic surfactants which may be solid or highly viscous at room temperature. If nonionic surfactants which are highly viscous at room temperature are used, then it is preferred that they have a viscosity above 20 Pas, preferably above 35 Pas, and in particular above 40 Pas. Nonionic surfactants which have a wax-like consistency at room temperature are also preferred.

Preferred nonionic surfactants that are to be used in solid form at room temperature originate from the groups of alkoxylated nonionic surfactants, in particular ethoxylated primary alcohols and mixtures of these surfactants with surfactants of more complex structure, such as polyoxypropylene/polyoxyethylene/polyoxypropylene (PO/EO/PO) surfactants. Such (PO/EO/PO) nonionic surfactants are distinguished, moreover, by good foam control.

In a preferred embodiment of the present invention, the nonionic surfactant with a melting point above room temperature is an ethoxylated nonionic surfactant originating from the reaction of a monohydroxyalkanol or alkylphenol having 6 to 20 carbon atoms with preferably at least 12 mol, particularly preferably at least 15 mol, in particular at least 20 mol, of ethylene oxide per mole of alcohol or alkylphenol.

A particularly preferred nonionic surfactant to be used that is solid at room temperature is obtained from a straight-chain fatty alcohol having 16 to 20 carbon atoms ($C_{16-20}$-alcohol), preferably a $C_{1-8}$-alcohol and at least 12 mol, preferably at least 15 mol and in particular at least 20 mol, of ethylene oxide. Of these, the so-called "narrow range ethoxylates" (see above) are particularly preferred.

Accordingly, particularly preferred products according to the invention comprise ethoxylated nonionic surfactant(s) which has/have been obtained from $C_{6-20}$-monohydroxyalkanols or $C_{6-20}$-alkylphenols or $C_{16-20}$-fatty alcohols and more than 12 mol, preferably more than 15 mol and in particular more than 20 mol, of ethylene oxide per mole of alcohol.

The nonionic surfactant preferably additionally has propylene oxide units in the molecule. Preferably, such PO units constitute up to 25% by weight, particularly preferably up to 20% by weight and in particular up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol part of such nonionic surfactant molecules constitutes preferably more than 30% by weight, particularly preferably more than 50% by weight and in particular more than 70% by weight, of the total molar mass of such nonionic surfactants. Preferred rinse aids are characterized in that they comprise ethoxylated and propoxylated nonionic surfactants in which the polyethylene oxide units in the molecule constitute up to 25% by weight, preferably up to 20% by weight and in particular up to 15% by weight, of the total molar mass of the nonionic surfactant.

Further nonionic surfactants with melting points above room temperature which can particularly preferably be used comprise 40 to 70% of a polyoxypropylene/polyoxyethylene/polyoxypropylene block polymer blend which comprises 75% by weight of an inverted block copolymer of polyoxyethylene and polyoxypropylene with 17 mol of ethylene oxide and 44 mol of propylene oxide and 25% by weight of a block copolymer of polyoxyethylene and polyoxypropylene, initiated with trimethylolpropane and comprising 24 mol of ethylene oxide and 99 mol of propylene oxide per mole of trimethylolpropane.

Nonionic surfactants which can particularly preferably be used can be obtained, for example, under the name Poly Tergent® SLF-18 from Olin Chamicals.

A further preferred rinse aid according to the invention comprises nonionic surfactants of the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x represents values between 0.5 and 1.5 and y represents a value of at least 15.

Further nonionic surfactants which can preferably be used are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j represent values between 1 and 12, preferably between 1 and 5. If the value x is >2, each $R^3$ in the above formula may be different. $R^1$ and $R^2$ are preferably linear or branched, saturated or unsaturated, aliphatic or aromatic hydrocarbon radicals having 6 to 22 carbon atoms, radicals having 8 to 18 carbon atoms being particularly preferred. For the radical $R^3$, H, —$CH_3$ or —$CH_2CH_3$ are particularly preferred. Particularly preferred values for x are in the range from 1 to 20, in particular from 6 to 15.

As described above, each $R^3$ in the above formula may be different if x is ≧2. By this means it is possible to vary the alkylene oxide unit in the square brackets. If x, for example, is 3, the radical $R^3$ may be selected in order to form ethylene oxide ($R^3$=H) or propylene oxide ($R^3$=$CH_3$) units, which may be added onto one another in any sequence, examples being (EO) (PO) (EO), (EO)(EO)(PO), (EO)(EO)(EO), (PO)(EO)(PO), (PO)(PO)(EO) and (PO) (PO) (PO). The value 3 for x has been chosen here by way of example and it is entirely possible for it to be larger, the scope for variation increasing with increasing values of x and embracing, for example, a large number of (EO) groups, combined with a small number of (PO) groups, or vice versa.

Particularly preferred terminally capped poly(oxyalkylated) alcohols of the above formula have values of k=1 and j=1, thereby simplifying the above formula to $$R^1O[CH_2CH(R^3)O]_xCH_2CH(OH)CH_2OR^2$$

In the last-mentioned formula, $R^1$, $R^2$ and $R^3$ are as defined above and x represents numbers from 1 to 30, preferably from 1 to 20 and in particular from 6 to 18. Particular preference is given to surfactants in which the radicals $R^1$ and $R^2$ have 9 to 14 carbon atoms, $R^3$ is H, and x assumes values from 6 to 15.

Summarizing the last-mentioned statements, preference is given to rinse aids according to the invention which comprise terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j are values between 1 and 12, preferably between 1 and 5, where surfactants of the type $$R^1O[CH_2CH(R^3)O]_xCH_2CH(OH)CH_2OR^2$$

in which x represents numbers from 1 to 30, preferably from 1 to 20 and in particular from 6 to 18, are particularly preferred.

It is also possible to use anionic, cationic and/or amphoteric surfactants in conjunction with said surfactants; due to their foaming behavior, the former are only of minor importance in machine dishwasher products and are in most cases used only in amounts below 10% by weight, in most cases even below 5% by weight, for example from 0.01 to 2.5% by weight, in each case based on the product. The products according to the invention may thus also comprise anionic, cationic and/or amphoteric surfactants as surfactant component.

The anionic surfactants used are, for example, those of the sulfonate and sulfate type. Suitable surfactants of the sulfonate type are, preferably, $C_{9-13}$-alkylbenzenesulfonates, olefinsulfonates, i.e. mixtures of alkene- and hydroxyalkanesulfonates, and disulfonates, as are obtained, for example, from $C_{12-18}$-monoolefins having a terminal or internal double bond by sulfonation with gaseous sulfur trioxide and subsequent alkaline or acidic hydrolysis of the sulfonation products. Also suitable are alkanesulfonates, which are obtained from $C_{12-18}$-alkanes, for example by sulfochlorination or sulfoxidation with subsequent hydrolysis or neutralization, respectively. Likewise suitable are also the esters of α-sulfo fatty acids (ester sulfonates), e.g. the α-sulfonated methyl esters of hydrogenated coconut, palm kernel or tallow fatty acids.

Further suitable anionic surfactants are sulfated fatty acid glycerol esters. Fatty acid glycerol esters are understood as meaning the monoesters, diesters and triesters, and mixtures thereof, as are obtained in the preparation by esterification of a monoglycerol with 1 to 3 mol of fatty acid or in the transesterification of triglycerides with 0.3 to 2 mol of glycerol. Preferred sulfated fatty acid glycerol esters here are the sulfonation products of saturated fatty acids having 6 to 22 carbon atoms, for example those of caproic acid, caprylic acid, capric acid, myristic acid, lauric acid, palmitic acid, stearic acid or behenic acid.

Preferred alk(en)yl sulfates are the alkali metal salts, and in particular the sodium salts, of the sulfuric monoesters of $C_{12}$–$C_{18}$-fatty alcohols, for example those of coconut fatty alcohol, tallow fatty alcohol, lauryl, myristyl, cetyl or stearyl alcohol or of $C_{10}$–$C_{20}$-oxo alcohols, and those monoesters of secondary alcohols of these chain lengths. Preference is also given to alk(en)yl sulfates of said chain length which contain a synthetic straight-chain alkyl radical prepared on a petrochemical basis, and which have a degradation behavior analogous to that of the corresponding compounds based on fatty-chemical raw materials. From a washing technology viewpoint, the $C_{12}$–$C_{16}$-alkyl sulfates and $C_{12}$–$C_{15}$-alkyl sulfates and also $C_{14}$–$C_{15}$-alkyl sulfates are preferred. In addition, 2,3-alkyl sulfates, which and can be obtained as commercial products from Shell Oil Company under the name DAN®, are suitable anionic surfactants.

Also suitable are the sulfuric monoesters of the straight-chain or branched $C_{7-21}$-alcohols ethoxylated with 1 to 6 mol of ethylene oxide, such as 2-methyl-branched $C_{9-11}$-alcohols containing, on average, 3.5 mol of ethylene oxide (EO) or $C_{12-18}$-fatty alcohols having 1 to 4 EO. Due to their high foaming behavior, they are used in cleaning compositions only in relatively small amounts, for example in amounts of from 1 to 5% by weight.

Further suitable anionic surfactants are also the salts of the alkylsulfosuccinic acid, which are also referred to as sulfosuccinates or as sulfosuccinic esters and which represent monoesters and/or diesters of sulfosuccinic acid with alcohols, preferably fatty alcohols and in particular ethoxylated fatty alcohols. Preferred sulfosuccinates comprise $C_{8-18}$-fatty alcohol radicals or mixtures of these. Particularly preferred sulfosuccinates comprise a fatty alcohol radical derived from ethoxylated fatty alcohols, which themselves represent nonionic surfactants (for description see below). Here, particular preference is in turn given to sulfosuccinates whose fatty alcohol radicals are derived from ethoxylated fatty alcohols having a narrowed homolog distribution. It is likewise also possible to use alk(en)ylsuccinic acid with preferably 8 to 18 carbon atoms in the alk(en)yl chain or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and in particular mixtures of soaps derived from natural fatty acids, e.g. coconut, palm kernel or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts.

As cationic active substances, the products according to the invention may, for example, comprise cationic compounds of the formulae XI, XII or XIII, (XI)

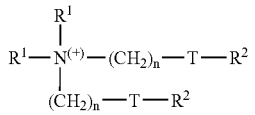

(XII)

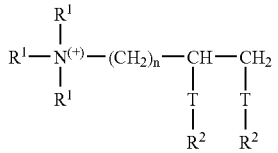

(XIII)

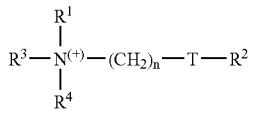

in which each group $R^1$, independently of the others, is chosen from $C_{1-6}$-alkyl, -alkenyl or -hydroxyalkyl groups; each $R^2$, independently of the others, is chosen from $C_{8-28}$-alkyl or -alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO— or —CO—O— and n is an integer from 0 to 5.

In addition to the ingredients a) to c), the compositions according to the invention comprise water and optionally further customary ingredients of cleaning compositions. The compositions can be completely water-based, i.e. comprise no further solvents; it is, however, also possible for further nonaqueous solvents to be present in the compositions according to the invention in addition to the water. This may, for example, result from the fact that certain ingredients are supplied in nonaqueous solvents, or that certain formulations are more stable in the presence of certain nonaqueous solvents or have better rheological properties.

Preferred nonaqueous solvents to be used originate, for example, from the groups of monoalcohols, diols, triols or polyols, ethers, esters and/or amides. Particular preference is given here to nonaqueous solvents which are water-soluble, "water-soluble" solvents for the purposes of the present application being solvents which are completely miscible, i.e. without miscibility gaps, with water at room temperature.

Nonaqueous solvents which can be used in the products according to the invention preferably originate from the group of mono- or polyhydric alcohols, alkanolamines or glycol ethers, provided they are miscible with water in the stated concentration range. The solvents are preferably chosen from ethanol, n- or i-propanol, butanols, glycol, propanediol or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy, ethoxy or butoxy triglycol, 1-butoxyethoxy-2-propanol, 3-methyl-3-methoxybutanol, propylene glycol t-butyl ether, and mixtures of these solvents.

Particularly preferred machine dishwasher products are characterized in that the nonaqueous solvent(s) is/are chosen from the group of polyethylene glycols and polypropylene glycols, glycerol, glycerol carbonate, triacetin, ethylene glycol, propylene glycol, propylene carbonate, hexylene glycol, ethanol, and n-propanol and/or isopropanol.

Preferred machine dishwasher products according to the invention are characterized in that they additionally comprise 5 to 50% by weight, preferably 7.5 to 40% by weight and in particular 10 to 30% by weight of nonaqueous solvent(s), in each case based on the total product.

As well as the above-described builders, bleaches, bleach activators, enzymes, silver protectants, dyes and fragrances etc. in particular are preferred ingredients of machine dishwasher products. In addition, further ingredients may be present, preference being given to machine dishwasher products according to the invention which additionally comprise one or more substances from the group of acidifying agents, chelate completing agents or of deposit-inhibiting polymers.

Possible acidifiers are either inorganic acids or organic acids provided these are compatible with the other ingredients. For reasons of consumer protection and handling safety, the solid mono-, oligo- and polycarboxylic acids in particular can be used. From this group, preference is in turn given to citric acid, tartaric acid, succinic acid, malonic acid, adipic acid, maleic acid, fumaric acid, oxalic acid, and polyacrylic acid. The anhydrides of these acids can also be used as acidifiers, maleic anhydride and succinic anhydride in particular being commercially available. Organic sulfonic acids, such as amidosulfonic acid can likewise be used. A product which is commercially available and which can likewise preferably be used as acidifier for the purposes of the present invention is Sokalan® DCS (trade mark of BASF), a mixture of succinic acid (max. 31% by weight), glutaric acid (max. 50% by weight) and adipic acid (max. 33% by weight).

A further possible group of ingredients are the chelate complexing agents. Chelate complexing agents are substances which form cyclic compounds with metal ions, where a single ligand occupies more than one coordination site on a central atom, i.e. is at least "bidentate". In this case, stretched compounds are thus normally closed by complex formation via an ion to give rings. The number of bonded ligands depends on the coordination number of the central ion.

Chelate complexing agents which are customary and preferred for the purposes of the present invention are, for example, polyoxycarboxylic acids, polyamines, ethylenediaminetetraacetic acid (EDTA) and nitrilotriacetic acid (NTA). Complex-forming polymers, i.e. polymers which carry functional groups either in the main chain itself or laterally relative to this, which can act as ligands and react with suitable metal atoms usually to form chelate complexes, can also be used according to the invention. The polymer-bonded ligands of the resulting metal complexes can originate from just one macromolecule or else belong to different polymer chains. The latter leads to crosslinking of the material, provided the complex-forming polymers have not already been crosslinked beforehand via covalent bonds.

Complexing groups (ligands) of customary complex-forming polymers are iminodiacetic acid, hydroxyquinoline, thiourea, guanidine, dithiocarbamate, hydroxamic acid, amidoxime, aminophosphoric acid, (cycl.) polyamino, mercapto, 1,3-dicarbonyl and crown ether radicals, some of which have very specific activities toward ions of different metals. Basis polymers of many complex-forming polymers, which are also commercially important, are polystyrene, polyacrylates, polyacrylonitriles, polyvinyl alcohols, polyvinylpyridines and polyethylenimines. Natural polymers, such as cellulose, starch or chitin are also complex-forming polymers. Moreover, these may be provided with further ligand functionalities as a result of polymer-analogous modifications.

For the purposes of the present invention, particular preference is given to machine dishwasher products which comprise one or more chelate complexing agents from the groups of (i) polycarboxylic acids in which the sum of the carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids,
(vi) cyclodextrins in amounts above 0.1% by weight, preferably above 0.5% by weight, particularly preferably above 1% by weight and in particular above 2.5% by weight, in each case based on the weight of the dishwasher product.

For the purposes of the present invention, it is possible to use all complexing agents of the prior art. These may belong to different chemical groups. Preference is given to using the following, individually or in a mixture with one another:

a) polycarboxylic acids in which the sum of the carboxyl and optionally hydroxyl groups is at least 5, such as gluconic acid,
b) nitrogen-containing mono- or polycarboxylic acids, such as ethylenediaminetetraacetic acid (EDTA), N-hydroxyethylethylenediaminetriacetic acid, diethylenetriaminepentaacetic acid, hydroxy-ethyliminodiacetic acid, nitridodiacetic acid-3-propionic acid, isoserinediacetic acid, N,N-di(β-hydroxyethyl)glycine, N-(1,2-dicarboxy-2-hydroxy-ethyl)glycine, N-(1,2-dicarboxy-2-hydroxyethyl)-aspartic acid or nitrilotriacetic acid (NTA),
c) geminal diphosphonic acids, such as 1-hydroxyethane-1,1-diphosphonic acid (HEDP), higher homologs thereof having up to 8 carbon atoms, and hydroxy or amino group-containing derivatives thereof and 1-aminoethane-1,1-diphosphonic acid, higher homologs thereof having up to 8 carbon atoms, and hydroxy or amino group-containing derivatives thereof,
d) aminophosphonic acids, such as ethylenediamine-tetra (methylenephosphonic acid), diethylenetri-aminepenta (methylenephosphonic acid) or nitrilotri-(methylenephosphonic acid),
e) phosphonopolycarboxylic acids, such as 2-phosphonobutane-1,2,4-tricarboxylic acid, and
f) cyclodextrins.

For the purposes of this patent application, polycarboxylic acids a) are understood as meaning carboxylic acids—including monocarboxylic acids—in which the sum of carboxyl and the hydroxyl groups present in the molecule is at least 5. Complexing agents from the group of nitrogen-containing polycarboxylic acids, in particular EDTA, are preferred.

At the alkaline pH values of the treatment solutions required according to the invention, these completing agents are at least partially in the form of anions. It is unimportant whether they are introduced in the form of acids or in the form of salts. In the case of using salts, alkali metal, ammonium or alkylammonium salts, in particular sodium salts, are preferred.

Deposit-inhibiting polymers may likewise be present in the products according to the invention. These substances, which may have chemically different structures, originate, for example, from the groups of low molecular weight polyacrylates with molar masses between 1000 and 20 000 daltons, preference being given to polymers with molar masses below 15 000 daltons.

Deposit-inhibiting polymers may also have cobuilder properties. Organic cobuilders which may be used in the machine dishwasher products according to the invention are, in particular, polycarboxylates/polycarboxylic acids, polymeric polycarboxylates, aspartic acid, polyacetals, dextrins, further organic cobuilders (see below) and phosphonates. These classes of substance are described below.

Organic builder substances which can be used are, for example, the polycarboxylic acids usable in the form of their sodium salts, the term polycarboxylic acids meaning carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids per se may also be used. In addition to their builder action, the acids typically also have the property of an acidifying component and thus also serve to establish a lower and milder pH of detergents or cleaners. In this connection, particular mention is made of citric acid, succinic acid, glutaric acid, adipic acid, gluconic acid and any mixtures thereof.

Also suitable as builders or deposit inhibitors are polymeric polycarboxylates; these are, for example, the alkali metal salts of polyacrylic acid or of polymethacrylic acid, for example those having a relative molecular mass of from 500 to 70 000 g/mol.

The molar masses given for polymeric polycarboxylates are, for the purposes of this specification, weight-average molar masses $M_W$ of the respective acid form, determined fundamentally by means of gel permeation chromatography (GPC) using a UV detector. The measurement was made against an external polyacrylic acid standard which, owing to its structural similarity to the polymers under investigation, provides realistic molecular weight values. These figures differ considerably from the molecular weight values obtained using polystyrenesulfonic acids as the standard. The molar masses measured against polystyrenesulfonic acids are usually considerably higher than the molar masses given in this specification.

Suitable polymers are, in particular, polyacrylates which preferably have a molecular mass of from 2000 to 20 000 g/mol. Owing to their superior solubility, preference in this group may be given in turn to the short-chain polyacrylates which have molar masses of from 2000 to 10 000 g/mol and particularly preferably from 3000 to 5000 g/mol.

Also suitable are copolymeric polycarboxylates, in particular those of acrylic acid with methacrylic acid and of acrylic acid or methacrylic acid with maleic acid. Copolymers which have proven to be particularly suitable are those of acrylic acid with maleic acid which contain from 50 to 90% by weight of acrylic acid and 50 to 10% by weight of maleic acid. Their relative molecular mass, based on free acids, is generally 2000 to 70 000 g/mol, preferably 20 000 to 50 000 g/mol and in particular 30 000 to 40 000 g/mol.

The (co)polymeric polycarboxylates can either be used as powders or as aqueous solutions. The (co)polymeric polycarboxylate content of the agents is preferably 0.5 to 20% by weight, in particular 3 to 10% by weight.

Particular preference is also given to biodegradable polymers of more than two different monomer units, for example those which contain, as monomers, salts of acrylic acid or of maleic acid, and vinyl alcohol or vinyl alcohol derivatives, or those which contain, as monomers, salts of acrylic acid and of 2-alkylallyl-sulfonic acid, and sugar derivatives. Further preferred copolymers are those which preferably have, as monomers, acrolein and acrylic acid/acrylic acid salts or acrolein and vinyl acetate.

Further preferred builder substances which are likewise to be mentioned are polymeric aminodicarboxylic acids, salts thereof or precursor substances thereof. Particular preference is given to polyaspartic acids or salts and derivatives thereof, which also have a bleach-stabilizing effect as well as cobuilder properties.

Further suitable builder substances are polyacetals which can be obtained by reacting dialdehydes with polyolcarboxylic acids which have 5 to 7 carbon atoms and at least 3 hydroxyl groups. Preferred polyacetals are obtained from dialdehydes, such as glyoxal, glutaraldehyde, terephthalaldehyde, and mixtures thereof and from polyolcarboxylic acids, such as gluconic acid and/or glucoheptonic acid.

Further suitable organic builder substances are dextrins, for example oligomers or polymers of carbohydrates, which can be obtained by partial hydrolysis of starches. The hydrolysis can be carried out in accordance with customary processes, for example acid-catalyzed or enzyme-catalyzed processes. The hydrolysis products preferably have average molar masses in the range from 400 to 500 000 g/mol. Preference is given here to a polysaccharide with a dextrose equivalent (DE) in the range from 0.5 to 40, in particular from 2 to 30, where DE is a common measure of the reducing effect of a polysaccharide compared with dextrose, which has a DE of 100. It is also possible to use maltodextrins with a DE between 3 and 20 and dried glucose syrups with a DE between 20 and 37, and also so-called yellow dextrins and white dextrins with relatively high molar masses in the range from 2000 to 30 000 g/mol.

The oxidized derivatives of such dextrins are their reaction products with oxidizing agents which are able to oxidize at least one alcohol function of the saccharide ring to the carboxylic acid function. A product oxidized on the $C_6$ of the saccharide ring may be particularly advantageous.

Oxydisuccinates and other derivatives of disuccinates, preferably ethylenediaminedisuccinate, are also further suitable cobuilders. Here, ethylenediamine N,N'-disuccinate (EDDS) is preferably used in the form of its sodium or magnesium salts. In this connection, preference is also given to glycerol disuccinates and glycerol trisuccinates. Suitable use amounts in zeolite-containing and/or silicate-containing formulations are 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and at most two acid groups.

A further class of substances with cobuilder properties is the phosphonates. These are, in particular, hydroxyalkane- and aminoalkanephosphonates. Among the hydroxyalkanephosphonates, 1-hydroxyethane-1,1-diphosphonate (HEDP) is of particular importance as cobuilder. It is preferably used as the sodium salt, the disodium salt giving a neutral reaction and the tetrasodium salt giving an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as the hexasodium salt of EDTMP or as the hepta- and octasodium salt of DTPMP. Here, preference is given to using HEDP as builder from the class of phosphonates. In addition, the aminoalkanephosphonates have a marked heavy metal-binding capacity. Accordingly, particularly if the agents also comprise bleaches, it may be preferable to use aminoalkanephosphonates, in particular DTPMP, or mixtures of said phosphonates.

In addition to the substances from the classes of substance given, the products according to the invention can comprise further customary ingredients of cleaning compositions, where bleaches, bleach activators, enzymes, silver protectants, dyes and fragrances in particular are of importance. These substances are described below.

Among the compounds which serve as bleaches and liberate $H_2O_2$ in water, sodium perborate tetrahydrate and sodium perborate monohydrate are of particular importance. Examples of further bleaches which may be used are sodium percarbonate, peroxypyrophosphates, citrate perhydrates and $H_2O_2$-supplying peracidic salts or peracids, such as perbenzoates, peroxophthalates, diperazelaic acid, phthaloiminoperacid or diperdodecanedioic acid. Cleaners according to the invention can also comprise bleaches from the group of organic bleaches. Typical organic bleaches are the diacyl peroxides, such as, for example, dibenzoyl peroxide. Further typical organic bleaches are the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimido-peroxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyl-di (6-aminopercaproic acid) can be used.

Bleaches which may be used in the cleaners according to the invention for machine dishwashing may also be substances which liberate chlorine or bromine. Among the suitable materials which liberate chlorine or bromine, suitable examples include heterocyclic N-bromoamides and N-chloroamides, for example trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Bleach activators, which assist the action of the bleaches, have already been mentioned above as a possible ingredient of the rinse aid particles. Known bleach activators are compounds which contain one or more N- or O-acyl groups, such as substances from the class of anhydrides, of esters, of imides and of acylated imidazoles or oximes. Examples are tetraacetylethylenediamine TAED, tetraacetylmethylenediamine TAMD and tetraacetylhexylenediamine TAHD, but also pentaacetylglucose PAG, 1,5-diacetyl-2,2-dioxohexahydro-1,3,5-triazine DADHT and isatoic anhydride ISA.

Bleach activators which can be used are compounds which, under perhydrolysis conditions, produce aliphatic peroxocarboxylic acids having preferably 1 to 10 carbon atoms, in particular 2 to 4 carbon atoms, and/or optionally substituted perbenzoic acid. Substances which carry O-acyl and/or N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic acid anhydrides, in particular phthalic anhydride, acylated polyhydric alcohols, in particular triacetin, ethylene glycol diacetate, 2,5-diacetoxy-2,5-dihydrofuran, n-methylmorpholinium acetonitrile methylsulfate (MMA), and enol esters and acetylated sorbitol and mannitol or mixtures thereof (SORMAN), acylated sugar derivatives, in particular pentaacetylglucose (PAG), pentaacetylfructose, tetraacetylxylose and octaacetyllactose, and acetylated, optionally N-alkylated, glucamine and gluconolactone, and/or N-acylated lactams, for example N-benzoylcaprolactam. Hydrophilically substituted acylacetals and acyllactams are likewise preferably used. Combinations of conventional bleach activators can also be used.

In addition to the conventional bleach activators, or instead of them, so-called bleach catalysts may also be incorporated into the rinse aid particles. These substances are bleach-boosting transition metal salts or transition metal complexes, such as, for example, Mn-, Fe-, Co-, Ru- or Mo-salen complexes or -carbonyl complexes. Mn, Fe, Co, Ru, Mo, Ti, V and Cu complexes with N-containing tripod ligands, and Co-, Fe-, Cu- and Ru-ammine complexes can also be used as bleach catalysts.

Preference is given to using bleach activators from the group of polyacylated alkylenediamines, in particular tetraacetylethylenediamine (TAED), N-acylimides, in particular N-nonanoylsuccinimide (NOSI), acylated phenolsulfonates, in particular n-nonanoyl- or isononanoyloxybenzensulfonate (n- or iso-NOBS), n-methylmorpholinium acetonitrile methylsulfate (MMA), preferably in amounts up to 10% by weight, in particular 0.1% by weight to 8% by weight, particularly 2 to 8% by weight and particularly preferably 2 to 6% by weight, based on the total agent.

Bleach-boosting transition metal complexes, in particular with the central atoms Mn, Fe, Co, Cu, Mo, V, Ti and/or Ru, preferably chosen from the group of manganese and/or cobalt salts and/or complexes, particularly preferably the cobalt (ammine) complexes, cobalt (acetato) complexes, cobalt (carbonyl) complexes, the chlorides of cobalt or manganese, manganese sulfate are used in customary amounts, preferably in an amount up to 5% by weight, in particular from 0.0025% by weight to 1% by weight and particularly preferably from 0.01% by weight to 0.25% by weight, in each case based on the total agent. However, in special cases, more bleach activator can also be used.

Suitable enzymes in the cleaners according to the invention are, in particular, those from the classes of hydrolases, such as the proteases, esterases, lipases or lipolytic enzymes, amylases, glycosyl hydrolases and mixtures of said enzymes. All of these hydrolases contribute to the removal of soilings such as protein-, grease- or starch-containing stains. For bleaching, it is also possible to use oxidoreductases. Especially suitable enzymatic active ingredients are those obtained from bacterial strains or fungi, such as *Bacillus subtilis, Bacillus licheniformis, Streptomyceus griseus, Coprinus cinereus* and *Humicola insolens*, and from genetically modified variants thereof. Preference is given to using proteases of the subtilisin type and in particular to proteases obtained from *Bacillus lentus*. Of particular interest here are enzyme mixtures, for example of protease and amylase or protease and lipase or lipolytic enzymes, or of protease, amylase and lipase or lipolytic enzymes, or protease, lipase or lipolytic enzymes, but in particular protease and/or lipase-containing mixtures or mixtures with lipolytic enzymes. Examples of such lipolytic enzymes are the known cutinases. Peroxidases or oxidases have also proven suitable in some cases. Suitable amylases include, in particular, alpha-amylases, isoamylases, pullulanases and pectinases.

The enzymes can be adsorbed on carrier substances or embedded in coating substances in order to protect them from premature decomposition. The proportion of enzymes, enzyme mixtures or enzyme granules can, for example, be about 0.1 to 5% by weight, preferably 0.5 to about 4.5% by weight.

For the purposes of the present invention, particular preference is given to the use of liquid enzyme formulations. Preference is given here to machine dishwasher products according to the invention which additionally comprise enzymes and/or enzyme preparations, preferably solid and/or liquid protease preparations and/or amylase preparations, in amounts of from 1 to 5% by weight, preferably from 1.5 to 4.5 and in particular from 2 to 4% by weight, in each case based on the total product.

Dyes and fragrances can be added to the machine dishwasher products according to the invention in order to improve the esthetic impression of the resulting products and to provide the consumer with performance coupled with a visually and sensorily "typical and unmistakable" product. Perfume oils or fragrances which may be used are individual odorant compounds, e.g. the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether, and the aldehydes include, for example, the linear alkanals having 8–18 carbon atoms, citral, citronellal, citronellyloxyacetaldehyde, cyclamenaldehyde, hydroxycitronellal, lilial and bourgeonal, and the ketones include, for example, the ionones, α-isomethylionone and methyl cedryl ketone, and the alcohols include anethol, citronellol, eugenol, geraniol, linalool, phenylethyl alcohol and terpineol, and the hydrocarbons include primarily the terpenes, such as limonene and pinene. Preference is, however, given to using mixtures of different odorants which together produce a pleasing scent note. Such perfume oils can also contain natural odorant mixtures, as are obtainable from plant sources, e.g. pine oil, citrus oil, jasmine oil, patchouli oil, rose oil and ylang ylang oil. Likewise suitable are muscatel, sage oil, camomile oil, oil of cloves, melissa oil, mint oil, cinnamon leaf oil, lime blossom oil, juniperberry oil, vetiver oil, olibanum oil, galbanum oil and labdanum oil, and orange blossom oil, neroliol, orange peel oil and sandalwood oil.

In order to improve the esthetic impression of the agents prepared according to the invention, it (or parts thereof) may be colored with suitable dyes. Preferred dyes, the choice of which does not present any problems at all to the person skilled in the art, have high storage stability and high insensitivity toward the other ingredients of the agents and toward light, and do not have marked substantivity toward the substrates to be treated with the agents, such as glass, ceramic or plastic dishware, in order not to dye these.

The machine dishwasher products of the present invention can be further improved with regard to corrosion protection on metal surfaces (in particular on silver surfaces) and/or with regard to the protection of glassware against glass corrosion.

It is a generally known fact that silver "tarnishes" even when it is not being used. It is only a question of time until it has dark, brownish, bluish to blue-black marks or becomes discolored overall and has thus "tarnished" in customary language usage. With the machine cleaning of table silver too, there are in practice again and again problems in the form of tarnishing and discoloration of silver surfaces. Silver can react to silver-containing substances which are dissolved or dispersed in the wash water since, during dishwashing in domestic dishwashing machines (DDM), food residues and thus, inter alia, also mustard, peas, egg and other sulfur-containing compounds, such as cystine and cysteine, are introduced into the wash liquor. The much higher temperatures during machine washing and the longer contact times with the sulfur-containing food residues also favor the tarnishing of silver compared with manual washing. Furthermore, the silver surface is completely degreased by the intensive washing process in the dishwasher and thereby more sensitive to chemical influences.

When using cleaners containing active chlorine, the tarnishing as a result of sulfur-containing compounds can be largely prevented since these compounds are converted to sulfones or sulfates by oxidation of the sulfidic functions in secondary reactions.

However, the problem of silver tarnishing has come to the fore again as active oxygen compounds, such as, for example, sodium perborate or sodium percarbonate, have been used as an alternative to the active chlorine compounds; these serve to remove bleachable soilings, such as, for example, tea stains/tea deposits, coffee residues, dyes from vegetables, lipstick residues and the like.

These active oxygen compounds are used together with bleach activators primarily in modern low-alkaline machine dishwasher products of the new detergent generation. These modern compositions consist essentially of the following functional building blocks: builder component (complexing agent/dispersant), alkali carrier, bleaching system (bleach+bleach activator), enzymes and wetting agents (surfactants).

The silver surfaces react in a fundamentally more sensitive way to the changed formulation parameters of the new active chlorine-free detergent generation with reduced pH values and activated oxygen bleach. During machine washing, these products release the actual bleaching agent hydrogen peroxide or active oxygen in the wash cycle. The bleaching effect of the detergents containing active oxygen is enhanced by bleach activators so that a good bleaching effect is achieved even at low temperatures. In the presence of these bleach activators, peracetic acid is formed as a reactive intermediate compound. Under these changed wash conditions, in the presence of silver, the deposits are not only sulfidic, but preferably oxidic as a result of the oxidizing attack of the peroxides formed as intermediates or of the active oxygen. If the content of salt is high, chloridic deposits may additionally form. Silver tarnishing is additionally exacerbated as a result of relatively high residual water hardnesses during the cleaning cycle.

The cleaning compositions according to the invention can therefore comprise corrosion inhibitors to protect the ware or the machine, silver protectants in particular being of particular importance in the area of machine dishwashing. The known substances of the prior art can be used. In general, it is primarily possible to use silver protectants chosen from the group of triazoles, of benzotriazoles, of bisbenzotriazoles, of aminotriazoles, of alkylaminotriazoles and of transition metal salts or complexes. It is particularly preferred to use benzotriazole and/or alkylaminotriazole. Moreover, cleaning formulations often comprise active-chlorine-containing agents which are able to significantly prevent corrosion of the silver surface. In chlorine-free cleaners, oxygen- and nitrogen-containing organic redox-active compounds, such as di- and trihydric phenols, e.g. hydroquinone, pyrocatechol, hydroxyhydroquinone, gallic acid, phloroglucine, pyrogallol or derivatives of these classes of compounds are particularly.

Said problems can yet better be solved using the products according to the invention if, in addition to the organic silver protectants, or instead of them, certain corrosion inhibitors are incorporated into the products. The present invention thus further provides liquid aqueous machine dishwashing products according to the invention which are characterized in that they additionally comprise one or more redox-active substances from the group of manganese, titanium, zirconium, hafnium, vanadium, cobalt and cerium salts and/or complexes, where the metals are preferably in one of the oxidation states II, III, IV, V or VI.

Instead of or in addition to the silver protectants described above, for example the benzotriazoles, redox-active substances are used in this preferred embodiment. These substances are inorganic redox-active substances from said groups, preference being given to metal salts and/or metal complexes in which the metals are present in one of the oxidation states II, III, IV, V or VI.

The metal salts or metal complexes used should be at least partially soluble in water. The counterions suitable for salt formation include all customary singly, doubly or triply negatively charged inorganic anions, e.g. oxide, sulfate, nitrate, fluoride, but also organic anions, such as, for example, stearate.

Metal complexes for the purpose of the invention are compounds which consist of a central atom and one or more ligands, and optionally additionally one or more of the abovementioned anions. The central atom is one of the abovementioned metals in one of the abovementioned oxidation states. The ligands are neutral molecules or anions which are mono- or polydentate; the term "ligands" for the purposes of the invention is described in more detail, for example, in "Römpp Chemie Lexikon, Georg Thieme Verlag Stuttgart/New York, $9^{th}$ edition, 1990, page 2507". If the charge of the central atom and the charge of the ligand(s) do not add up to zero, then, depending whether the charge excess is cationic or anionic, either one or more of the abovementioned anions or one or more cations, e.g. sodium, potassium, ammonium ions, ensure charge balance. Suitable complexing agents are, for example, citrate, acetylacetonate or 1-hydroxyethane-1,1-diphosphonate.

The definition of "oxidation state" customary in chemistry is given, for example, in "Rompp Chemie Lexikon, Georg Thieme Verlag Stuttgart/New York, $9^{th}$ edition, 1991, page 3168".

Particularly preferred metal salts and/or metal complexes are chosen from the group $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ and mixtures thereof, meaning that preferred liquid aqueous machine dishwasher products according to the invention are characterized in that the metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$.

These metal salts or metal complexes are generally standard commercial substances which can be used in the products according to the invention for the purpose of silver corrosion protection without prior cleaning. Thus, for example, the mixture, known from the production of $SO_3$ (contact process), of five- and four-valent vanadium ($V_2O_5$, $VO_2$, $V_2O_4$) is suitable, as is titanyl sulfate, $TiOSO_4$, which is formed by diluting a $Ti(SO_4)_2$ solution.

The inorganic redox-active substances, in particular metal salts or metal complexes, are preferably coated, i.e. coated completely with a material which is water-tight but readily soluble at the washing temperatures, in order to prevent their premature decomposition or oxidation during storage. Preferred coating materials, which are applied by known processes, for example melt coating processes according to Sandwik from the food industry, are paraffins, microwaxes, waxes of natural origin, such as carnauba wax, candelilla wax, beeswax, higher-melting alcohols, such as, for example, hexadecanol, soaps or fatty acids. In this connection, the coating material, which is solid at room temperature, is applied in the molten state to the material to be coated, e.g. by spinning finely divided material to be coated in a continuous stream through a spray-mist zone of the molten coating material likewise produced continuously. The melting point must be chosen such that the coating material is readily soluble or rapidly melts during the silver treatment. The melting point should ideally be in the range between 45° C. and 65° C. and preferably in the range 50° C. to 60° C.

Said metal salts and/or metal complexes are present in the liquid aqueous machine dishwashing products according to the invention preferably in an amount of from 0.05 to 6% by weight, preferably 0.2 to 2.5% by weight, based on the total product.

In a further embodiment, the present invention provides products which have been further improved with regard to the corrosion protection on glass surfaces.

An important criterion for assessing a machine dishwasher product is, as well as its cleaning performance, the optical appearance of the dry dishes after cleaning has taken place. Any calcium carbonate deposits which may arise on the dishes or in the inside of the machine may, for example, have a negative effect on customer satisfaction and thus have a causal influence on the economic success of such a dishwasher product. A further problem which has been in existence for a long time with machine dishwashing is the corrosion of glassware, which may usually manifest itself in the appearance of clouding, streaking or scratching, or else by iridescence of the glass surface. The observed effects are based essentially on two processes, the emergence of alkali metal and alkaline earth metal ions from the glass in conjunction with hydrolysis of the silicate network, secondly a deposition of silicatic compounds on the glass surface.

Said problems can be even better solved with products according to the invention if, in addition to the ingredients described above, certain glass corrosion inhibitors are incorporated into the products. This invention therefore further provides liquid, aqueous dishwasher products according to the invention which additionally comprise one or more magnesium and/or zinc salts and/or magnesium and/or zinc complexes.

A preferred class of compounds which can be added to the products according to the invention to prevent glass corrosion are insoluble zinc salts. During the dishwashing process, these can position themselves on the glass surface, where they prevent the metal ions from the glass network entering into solution, and also hydrolysis of the silicates. In addition, these insoluble zinc salts also prevent the deposition of silicate on the glass surface, meaning that the glass is protected from the consequences described above.

Insoluble zinc salts for the purposes of this preferred embodiment are zinc salts which have a solubility of at most 10 grams of zinc salt per liter of water at 20° C. Examples of insoluble zinc salts which are particularly preferred according to the invention are zinc silicate, zinc carbonate, zinc oxide, basic zinc carbonate ($Zn_2(OH)_2CO_3$), zinc hydroxide, zinc oxalate, zinc monophosphate ($Zn_3$ ($PO_4$) 2) and zinc pyrophosphate ($Zn_2$ ($P_2O_7$)

Said zinc compounds are used in the products according to the invention in amounts which result in a content of zinc ions in the product of between 0.02 and 10% by weight, preferably between 0.1 and 5.0% by weight and in particular between 0.2 and 1.0% by weight, in each case based on the product. The exact content of zinc salt or the zinc salts in the product is naturally dependent on the nature of the zinc salts—the less soluble the zinc salt used, the higher its concentration should be in the products according to the invention.

Since the insoluble zinc salts remain unchanged for the greatest part during the dishwashing operation, the particle size of the salts is a criterion which should be taken into consideration so that the salts do not adhere to glassware or parts of the machine. In this connection, preference is given to liquid aqueous machine dishwasher products according to the invention in which the insoluble zinc salts have a particle size below 1.7 millimeters.

If the maximum particle size of the insoluble zinc salts is below 1.7 mm, insoluble residues in the dishwasher are not an issue. Preferably, the insoluble zinc salt has an average particle size which is significantly less than this value in order to further minimize the danger of insoluble residues, for example an average particle size of less than 250 μm. This applies all the more, the less soluble the zinc salt. In addition, the glass corrosion-inhibiting effectiveness increases with decreasing particle size. For very sparingly soluble zinc salts, the average particle size is preferably below 100 μm. For even more sparingly soluble salts, it may be even lower; for example average particle sizes below 100 μm are preferred for the very sparingly soluble zinc oxide.

A further preferred class of compounds are magnesium and/or zinc salt(s) of at least one monomeric and/or polymeric organic acid. These ensure that, even with repeated use, the surfaces of glassware are not changed by corrosion, in particular no clouding, streaking or scratching, and also no iridescence of the glass surfaces are caused.

Products according to the invention which comprise these substances are likewise preferred. Liquid aqueous machine dishwasher products which comprise one or more magnesium and/or zinc salt(s) of at least one monomeric and/or polymeric organic acid are further preferred embodiments of the present invention.

Although, in accordance with the invention, all magnesium and/or zinc salt(s) of monomeric and/or polymeric organic acids may be present in the claimed products, the magnesium and/or zinc salts of monomeric and/or polymeric organic acids from the groups of unbranched saturated or unsaturated monocarboxylic acids, of branched saturated or unsaturated monocarboxylic acids, of saturated and unsaturated dicarboxylic acids, of aromatic mono-, di- and tricarboxylic acids, of sugar acids, of hydroxy acids, of oxo acids, of amino acids and/or polymeric carboxylic acids, as described above, are preferred. Within this group, the acids listed below are preferred for the purposes of the present invention:

From the group of the unbranched saturated or unsaturated monocarboxylic acids: methanoic acid (formic acid), ethanoic acid (acetic acid), propanoic acid (propionic acid), pentanoic acid (valeric acid), hexanoic acid (caproic acid), heptanoic acid (enanthoic acid), octanoic acid (caprylic acid), nonanoic acid (pelargonic acid), decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), octadecanoic acid (stearic acid), eicosanoic acid (arachidic acid), docosanoic acid (behenic acid), tetracosanoic acid (lignoceric acid), hexacosanoic acid (cerotic acid), triacotanoic acid (melissic acid), 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid).

From the group of branched saturated or unsaturated monocarboxylic acids: 2-methylpentanoic acid, 2-ethylhexanoic acid, 2-propylheptanoic acid, 2-butyloctanoic acid, 2-pentylnonanoic acid, 2-hexyldecanoic acid, 2-heptylundecanoic acid, 2-octyldodecanoic acid, 2-nonyltridecanoic acid, 2-decyltetradecanoic acid, 2-undecylpentadecanoic acid, 2-dodecylhexadecanoic acid, 2-tridecylheptadecanoic acid, 2-tetradecyloctadecanoic acid, 2-pentadecylnonadecanoic acid, 2-hexadecyleicosanoic acid, 2-heptadecylheneicosanoic acid comprises.

From the group of unbranched saturated or unsaturated di- or tricarboxylic acids: propanedioic acid (malonic acid), butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), 2c-butenedioic acid (maleic acid), 2t-butenedioic acid (fumaric acid), 2-butynedicarboxylic acid (acetylenedicarboxylic acid).

From the group of aromatic mono-, di- and tricarboxylic acids: benzoic acid, 2-carboxybenzoic acid (phthalic acid), 3-carboxybenzoic acid (isophthalic acid), 4-carboxybenzoic acid (terephthalic acid), 3,4-dicarboxybenzoic acid (trimellitic acid), 3,5-dicarboxybenzoic acid (trimesionic acid).

From the group of sugar acids: galactonic acid, mannonic acid, fructonic acid, arabinonic acid, xylonic acid, riboic acid, 2-deoxyriboic acid, alginic acid.

From the group of hydroxy acids: hydroxyphenylacetic acid (mandelic acid), 2-hydroxypropionic acid (lactic acid), hydroxysuccinic acid (malic acid), 2,3-dihydroxybutanedioic acid (tartaric acid), 2-hydroxy-1,2,3-propanetricarboxylic acid (citric acid), ascorbic acid, 2-hydroxybenzoic acid (salicylic acid), 3,4,5-trihydroxybenzoic acid (gallic acid).

From the group of oxo acids: 2-oxopropionic acid (pyruvic acid), 4-oxopentanoic acid (levulinic acid).

From the group of amino acids: alanine, valine, leucine, isoleucine, proline, tryptophan, phenylalanine, methionine, glycine, serine, tyrosine, threonine, cysteine, asparagine, glutamine, aspartic acid, glutamic acid, lysine, arginine, histidine.

From the group of polymeric carboxylic acids: polyacrylic acid, polymethacrylic acid, alkylacrylamide/acrylic acid copolymers, alkylacrylamide/methacrylic acid copolymers, alkylacrylamide/methylmethacrylic acid copolymers, copolymers of unsaturated carboxylic acids, vinyl acetate/crotonic acid copolymers, vinylpyrrolidone/vinyl acrylate copolymers.

The spectrum of zinc salts preferred according to the invention of organic acids, preferably organic carboxylic acids, ranges from salts which are sparingly soluble or insoluble in water, i.e. have a solubility below 100 mg/l, preferably below 10 mg/l, in particular have no solubility, to those salts which have a solubility in water above 100 mg/l, preferably above 500 mg/l, particularly preferably above 1 g/l and in particular above 5 g/l (all solubilities at a water temperature of 20° C.). The first group of zinc salts includes, for example, zinc citrate, zinc oleate and zinc stearate, and the group of soluble zinc salts includes, for example, zinc formate, zinc acetate, zinc acetate and zinc gluconate:

In a further preferred embodiment of the present invention, the products according to the invention comprise at least one zinc salt, but no magnesium salt of an organic acid, which is preferably at least one zinc salt of an organic carboxylic acid, particularly preferably a zinc salt from the group consisting of zinc stearate, zinc oleate, zinc gluconate, zinc acetate, zinc acetate and/or zinc citrate. Zinc ricinoleate, zinc abietate and zinc oxalate are also preferred.

A product preferred for the purposes of the present invention comprises zinc salt in amounts of from 0.1 to 5% by weight, preferably from 0.2 to 4% by weight and in particular from 0.4 to 3% by weight, or zinc in oxidized form (calculated as $Zn^{2+}$) in amounts of from 0.01 to 1% by weight, preferably from 0.02 to 0.5% by weight and in particular from 0.04 to 0.2% by weight, in each case based on the total weight of the machine dishwasher product.

The liquid machine dishwasher products according to the invention can also comprise viscosity regulators or thickeners to establish any desired higher viscosity. In this connection, it is possible to use all known thickeners, i.e. those based on natural or synthetic polymers.

Naturally occurring polymers which are used as thickeners are, for example, agar agar, carrageen, tragacanth, gum arabic, alginates, pectins, polyoses, guar flour, carob seed flour, starch, dextrins, gelatins and caseine. Modified natural substances originate primarily from the group of modified starches and celluloses, examples which may be mentioned here being carboxymethylcellulose and other cellulose ethers, hydroxyethylcellulose and hydroxypropylcellulose, and carob flour ether.

A large group of thickeners which are used widely in very diverse fields of application are the completely synthetic polymers, such as polyacrylic and polymethacrylic compounds, vinyl polymers, polycarboxylic acids, polyethers, polyimines, polyamides and polyurethanes.

Thickeners from said classes of substance are commercially broadly available and are obtainable, for example, under the trade names Acusol®-820 (methacrylic acid (stearyl alcohol-20 EO) ester-acrylic acid copolymer, 30% strength in water, Rohm & Haas), Dapral®-GT-282-S (alkyl polyglycol ether, Akzo), Deuterol® polymer-11 (dicarboxylic acid copolymer, Schoner GmbH), Deuteron®-XG (anionic heteropolysaccharide based on β-D-glucose, D-manose, D-glucuronic acid, Schoner GmbH), Deuteron®-XN (nonionogenic polysaccharide, Schoner GmbH), Dicrylan® thickener-O (ethylene oxide adduct, 50% strength in water/isopropanol, Pfersse Chemie), EMA®-81 and EMA®-91 (ethylene-maleic anhydride copolymer, Monsanto), thickener-QR-1001 (polyurethane emulsion, 19–21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflow®-S (high molecular weight polysaccharide, stabilized with formaldehyde, Shell) and Shellflo®-XA (xanthan biopolymer, stabilized with formaldehyde, Shell).

A preferred polymeric thickener is xanthan, a microbial anionic heteropolysaccharide which is produced by *Xanthomonas campestris* and some other species under aerobic conditions and has a molar mass of from 2 to 15 million daltons. Xanthan is formed from a chain with β-1,4-bonded glucose (cellulose) with side chains. The structure of the subgroups consists of glucose, mannose, glucuronic acid, acetate and pyruvate, where the number of pyruvate units determines the viscosity of the xanthan.

Thickeners likewise to be used preferably for the purposes of the present invention are polyurethanes or modified polyacrylates which, based on the total product, can be used, for example, in amounts of from 0.1 to 5% by weight.

Polyurethanes (PURs) are prepared by polyaddition from di- or polyhydric alcohols and isocyanates and can be described by the general formula XIV

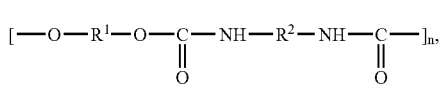

XIV in which $R^1$ is a low molecular weight or polymeric diol radical, $R^2$ is an aliphatic or aromatic group and n is a natural number. $R^1$ here is preferably a linear or branched $C_{2-12}$-alk(en)yl group, but can also be a radical of a polyhydric alcohol, as a result of which crosslinked polyurethanes are formed which differ from the formula XIV given above by virtue of the fact that further —O—CO—NH groups are bonded to the radical $R^1$.

Industrially important PURs are prepared from polyester- and/or polyetherdiols and, for example, e.g. from toluene 2,4- or 2,6-diisocyanate (TDI, $R^2=C_6H_3—CH_3$), 4,4'-methylenedi (phenylisocyanate) (MDI, $R^2=C_6H_4—CH_2—C_6H_4$) or hexamethylene diisocyanate [HMDI, $R^2=(CH_2)_6$].

Standard commercial thickeners based on polyurethane are available, for example, under the names Acrysol®PM 12 V (mixture of 3–5% modified starch and 14–16% PUR resin in water, Rohm & Haas), Borchigel® L75-N (nonionogenic PUR dispersion, 50% strength in water, Borchers), Coatex® BR-100-P (PUR dispersion, 50% strength in water/butyl glycol, Dimed), Nopco® DSX-1514 (PUR dispersion, 40% strength in water/butyl triglycol, Henkel-Nopco), thickener QR 1001 (20% strength PUR emulsion in water/diglycol ether, Rohm & Haas) and Rilanit® VPW-3116 (PUR dispersion, 43% strength in water, Henkel).

Modified polyacrylates which can be used for the purposes of the present invention are derived, for example, from acrylic acid or from methacrylic acid and can be described by the general formula XV

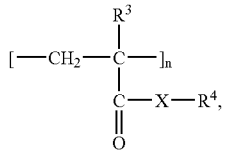

XV in which $R^3$ is H or a branched or unbranched $C_{1-4}$-alk(en)yl radical, X is N—$R^5$ or O, $R^4$ is an optionally alkoxylated branched or unbranched, possibly substituted $C_{8-22}$-alk(en)yl radical, $R^5$ is H or $R^4$ and n is a natural number. Generally, such modified polyacrylates are esters or amides of acrylic acid or of an α-substituted acrylic acid. Among these polymers, preference is given to those in which $R^3$ is H or a methyl group. In the polyacrylamides (X=N—$R^5$), either mono- ($R^5$=H) or di- ($R^5=R^4$) N-substituted amide structures are possible, where the two hydrocarbon radicals which are bonded to the N atom can be chosen independently of one another from optionally alkoxylated branched or unbranched $C_{8-22}$-alk(en)yl radicals. Among the polyacrylic esters (X=O), preference is given to those in which the alcohol has been obtained from natural or synthetic fats or oils and has additionally been alkoxylated, preferably ethoxylated. Preferred degrees of alkoxylation are between 2 and 30, particular preference being given to degrees of alkoxylation between 10 and 15.

Since the polymers which can be used are industrial compounds, the designation of the radicals bonded to X represents a statistical average value which can vary in individual cases with regard to chain length or degree of alkoxylation. Formula II gives merely formulae for idealized homopolymers. However, for the purposes of the present invention, it is also possible to use copolymers in which the proportion of monomer units which satisfy formula II is at least 30% by weight. Thus, for example, copolymers of modified polyacrylates and acrylic acid or salts thereof which also have acidic N atoms or basic —COO— groups can also be used.

Modified polyacrylates which are preferably to be used for the purposes of the present invention are polyacrylate-polymethacrylate copolymers which satisfy the formula XVa XVa

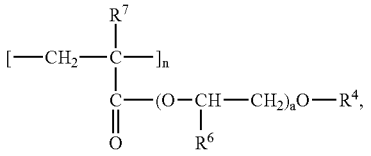

in which $R^4$ is a preferably unbranched, saturated or unsaturated $C_{8-22}$-alk(en)yl radical, $R^6$ and $R^7$, independently of one another, are H or $CH_3$, the degree of polymerization n is a natural number and the degree of alkoxylation a is a natural number between 2 and 30, preferably between 10 and 20. $R^4$ is preferably a fatty alcohol radical which has been obtained from natural or synthetic sources, the fatty alcohol in turn preferably being ethoxylated ($R^6$=H).

Products of the formula XVa are commercially available, for example under the name Acusol® 820 (Rohm & Haas) in the form of 30% strength by weight dispersions in water. In the case of said commercial product, $R^4$ is a stearyl radical, $R^6$ is a hydrogen atom, $R^7$ is H or $CH_3$ and the degree of ethoxylation a is 20.

Liquid machine dishwasher products preferred for the purposes of the present invention are characterized in that they additionally comprise 0.01 to 5% by weight, preferably 0.02 to 4% by weight, particularly preferably 0.05 to 3% by weight and in particular 0.1 to 1.5% by weight, of a polymeric thickener, preferably from the group of polyurethanes or of modified polyacrylates, with particular preference thickeners of the formula XV

XV

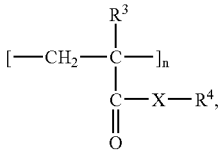

in which $R^3$ is H or a branched or unbranched $C_{1-4}$-alk(en)yl radical, X is N—$R^5$ or O, $R^4$ is an optionally alkoxylated branched or unbranched, possibly substituted $C_{8-22}$-alk(en)yl radical, $R^5$ is H or $R^4$ and n is a natural number.

The viscosity of the products according to the invention can be measured using customary standard methods (for example Brookfield viscometer LVT-II at 20 rpm and 20° C., spindle 3) and is preferably in the range from 500 to 5000 mPas. Preferred dishwasher product compositions have viscosities of from 1000 to 4000 mPas, with values between 1300 to 3000 mPas being particularly preferred. The pH of the products according to the invention is, in 1% strength by weight solution in distilled water, preferably within the range from 7 to 11, particularly preferably between 8 and 10 and especially between 8.5 and 9.5.

In a further embodiment, the present invention provides products which have been further improved with regard to the dosability by the consumer.

The nonaqueous liquid dishwasher products for machine dishwashing according to the invention can be supplied to the consumer in conventional containers, for example bottles, screw glassware, canisters, balloons, beakers or spray vessels, from which he meters these for use. Relatively high viscosity products can also be supplied in tubes or metered dispensers, as are known for toothpaste or sealing compositions. Such containers are nowadays usually prepared from non-water-soluble polymers and can, for example, consist of all customary water-insoluble packaging materials which are well known to the person skilled in the art in this field. Preferred polymers which may be mentioned here are, in particular, hydrocarbon-based plastics. Particularly preferred polymers include polyethylene, polypropylene (more preferably oriented polypropylene) and polymer mixtures, such as, for example, mixtures of said polymers with polyethylene terephthalate. Also suitable are one or more polymers from the group consisting of polyvinyl chloride, polysulfones, polyacetals, water-insoluble cellulose derivatives, cellulose acetate, cellulose propionate, cellulose acetobutyrate and mixtures of said polymers or copolymers comprising said polymers.

It may, however, also be desired to lend the consumer a helping hand in the form of preportioned products according to the invention so that he can utilize the dosing advantages known to him from the "tablet" supply form, and combine them with the rapid dissolution and release rate and the performance advantages of the products according to the invention. Such preportioned products according to the invention can likewise be in the form of water-insoluble packagings, so that the consumer has to open these prior to use in a suitable manner. It is, however, also possible and preferred to package portioned products according to the invention so that the consumer can place them into the dishwasher directly, i.e. together with the packaging, without further handling steps. Such packagings include water-soluble or water-disintegrable packagings such as pouches made of water-soluble film, pouches or other packagings made of water-soluble or water-disintegrable nonwovens or else flexible or rigid bodies made of water-soluble polymers, preferably in the form of filled hollow bodies which can be produced, for example, by deep-drawing, injection molding, blow molding, calendering etc.

The present invention therefore further provides liquid aqueous machine dishwasher products according to the invention which are packaged in portions in a water-soluble enclosure.

Preferably, nonaqueous liquid dishwasher products according to the invention comprise an enclosure which is completely or partially soluble in water. The shape of the enclosure is not limited to particular shapes. In principle, all archimedic and platonic bodies, i.e. three-dimensional shaped bodies, are suitable as enclosure shapes. Examples of the shape of the enclosure are capsules, cubes, spheres, egg-shaped bodies, cuboids, cones, rods or pouches. Hollow bodies with one or more compartments are also suitable as enclosure for the water-based liquid dishwasher products. In preferred embodiments of the invention, the enclosures have the form of capsules, as are also used, for example, in pharmacy for administering medicaments, of spheres or of pouches. The latter are preferably sealed or adhered on at least one side, where the adhesive used in particularly preferred embodiments of the invention is an adhesive which is water-soluble.

According to a preferred embodiment of the invention, the water-soluble polymer material which partially or completely surrounds the nonaqueous liquid dishwasher product is a water-soluble packaging. This is understood as meaning a flat component which partially or completely surrounds the water-based liquid dishwasher product. The exact shape of such a packaging is not critical and can be adapted largely to the use conditions. For example, processed plastic films or sheets, capsules and other conceivable shapes worked into different shapes (such as tubes, sachets, cylinders, bottles, disks or the like) are suitable. According to the invention, particular preference is given to films which can be adhered and/or sealed, for example, to give packagings such as tubes, sachets or the like after they have been filled with part portions of the cleaning compositions according to the invention or with the cleaning compositions according to the invention themselves.

Also preferred according to the invention are plastic film packagings made of water-soluble polymer materials due to the properties which can be matched in an excellent manner to the desired physical conditions. Such films are known in principle from the prior art.

In summary, hollow bodies of any shape, which can be produced by injection molding, bottle blowing, deep-drawing etc., and also hollow bodies made of films, in particular pouches, are preferred as packagings for portioned products according to the invention. Preferred liquid aqueous machine dishwasher products according to the invention are thus characterized in that the water-soluble enclosure comprises a pouch made of water-soluble film and/or an injection-molded section and/or a blow-molded section and/or a deep-drawn section.

According to the invention, it is preferred for one or more enclosure(s) to be sealed. This brings with it the advantage that the water-based liquid dishwasher products are optimally protected against environmental influences, in particular against moisture. In addition, by virtue of these sealed enclosures, it is possible to further develop the invention inasmuch as the cleaning compositions comprise at least one gas to protect the contents of the enclosure(s) against moisture, see below.

Suitable materials for the completely or partially water-soluble enclosure are in principle all materials which are completely or partially soluble in aqueous phase under the given conditions of a washing operation, rinsing operation or cleaning operation (temperature, pH, concentration of washing-active components). The polymer materials may particularly preferably belong to the groups consisting of (optionally partially acetalized) polyvinyl alcohol, polyvinylpyrrolidone, polyethylene oxide, gelatin, cellulose and derivatives thereof, starch and derivatives thereof, in particular modified starches, and mixtures (polymer blends, composites, coextrudates etc.) of said materials. Particular preference is given to gelatin and polyvinyl alcohols, and said two materials in each case in a composite with starch or modified starch. Inorganic salts and mixtures thereof are also suitable materials for the at least partially water-soluble enclosure.

Preferred liquid aqueous machine dishwasher products according to the invention are characterized in that the enclosure comprises one or more materials from the group consisting of acrylic acid-containing polymers, polyacrylamides, oxazoline polymers, polystyrene-sulfonates, polyurethanes, polyesters and polyethers and mixtures thereof.

Particularly preferred liquid aqueous machine dishwasher products according to the invention are characterized in that the enclosure comprises one or more water-soluble polymer(s), preferably a material from the group consisting of (optionally acetalized) polyvinyl alcohol (PYAL), polyvinylpyrrolidone, polyethylene oxide, gelatin, cellulose, and derivatives thereof and mixtures thereof, more preferably (optionally acetalized) polyvinyl alcohol (PVAL).

"Polyvinyl alcohols" (abbreviation PVAL, sometimes also PVOH) is here the name for polymers of the general structure

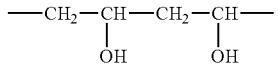

which also contain structural units of the type

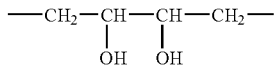

in small amounts (about 2%).

Standard commercial polyvinyl alcohols, which are supplied as white-yellowish powders or granules with degrees of polymerization in the range from about 100 to 2500 (molar masses from about 4000 to 100 000 g/mol), have degrees of hydrolysis of 98–99 or 87–89 mol % and thus also contain a residual content of acetyl groups. The polyvinyl alcohols are characterized on the part of the manufacturers by stating the degree of polymerization of the starting polymer, the degree of hydrolysis, the hydrolysis number and the solution viscosity.

Depending on the degree of hydrolysis, polyvinyl alcohols are soluble in water and less strongly polar organic solvents (formamide, dimethylformamide, dimethyl sulfoxide); they are not attacked by (chlorinated) hydrocarbons, esters, fats and oils. Polyvinyl alcohols are classified as being toxicologically acceptable and at least some of them are biodegradable. The solubility in water can be reduced by after-treatment with aldehydes (acetalization), by complexation with Ni or Cu salts or by treatment with dichromates, boric acid or borax. The coatings made of polyvinyl alcohol are largely impenetrable to gases such as oxygen, nitrogen, helium, oxygen, carbon dioxide, but allow water vapor to pass through.

For the purposes of the present invention, it is preferred that the enclosure comprises a polyvinyl alcohol whose degree of hydrolysis is 70 to 100 mol %, preferably 80 to 90 mol %, particularly preferably 81 to 89 mol % and in particular 82 to 88 mol %.

As materials for the enclosure, preference is given to using polyvinyl alcohols of a certain molecular weight range, it being preferred according to the invention for the enclosure to comprise a polyvinyl alcohol whose molecular weight is in the range from 10 000 to 100 000 $gmol^{-1}$, preferably from 11 000 to 90 000 $gmol^{-1}$, particularly preferably from 12 000 to 80 000 $gmol^{-1}$ and in particular from 13 000 to 70 000 $gmol^{-1}$.

The degree of polymerization of such preferred polyvinyl alcohols is between approximately 200 to approximately 2100, preferably between approximately 220 to approximately 1890, particularly preferably between approximately 240 to approximately 1680 and in particular between approximately 260 to approximately 1500.

The polyvinyl alcohols described above are commercially available widely, for example under the trade name Mowiol® (Clariant). Polyvinyl alcohols which are particularly suitable for the purposes of the present invention are, for example, Mowiol® 3-83, Mowiol® 4-88, Mowiol® 5-88 and Mowiol® 8-88.

Further polyvinyl alcohols which are particularly suitable as material for the hollow bodies are given in the table below:

| Name | Degree of hydrolysis [%] | Molar mass [kDa] | Melting point [° C.] |
|---|---|---|---|
| Airvol ® 205 | 88 | 15–27 | 230 |
| Vinex ® 2019 | 88 | 15–27 | 170 |
| Vinex ® 2144 | 88 | 44–65 | 205 |
| Vinex ® 1025 | 99 | 15–27 | 170 |
| Vinex ® 2025 | 88 | 25–45 | 192 |
| Gohsefimer ® 5407 | 30–28 | 23 600 | 100 |
| Gohsefimer ® LL02 | 41–51 | 17 700 | 100 |

Further polyvinyl alcohols suitable as material for the hollow shape are ELVANOL® 51-05, 52-22, 50-42, 85-82, 75-15, T-25, T-66, 90-50 (trade name of Du Pont), ALCOTEX® 72.5, 78, B72, F80/40, F88/4, F88/26, F88/40, F88/47 (trade name of Harlow Chemical Co.), Gohsenol® NK-05, A-300, AH-22, C-500, GH-20, GL-03, GM-14L, KA-20, KA-500, KH-20, KP-06, N-300, NH-26, NM11Q, KZ-06 (trade name of Nippon Gohsei K.K.).

The solubility of PVAL in water can be changed by after-treatment with aldehydes (acetalization) or ketones (ketalization). Polyvinyl alcohols which have proven to be particularly preferred and particularly advantageous due to their outstandingly good solubility in cold water are those which are acetalized or ketalized with the aldehyde or keto groups, respectively, of saccharides or polysaccharides and mixtures thereof. It has proven especially advantageous to use the reaction products of PVAL and starch.

In addition, the solubility in water can be changed by complexation with Ni or Cu salts or by treatment with dichromates, boric acid, borax and thus be adjusted to desired values in a targeted manner. Films made of PVAL are largely impenetrable to gases such as oxygen, nitrogen, helium, hydrogen, carbon dioxide, but allow water vapor to pass through.

Examples of suitable water-soluble PVAL films are the PVAL films obtainable under the name "SOLUBLON®" from Syntana Handelsgesellschaft E. Harke GmbH & Co. Their solubility in water can be adjusted to a precise degree and films of this product series are available which are soluble in the aqueous phase in all temperature ranges relevant for the application.

Polyvinylpyrrolidones, shortened to PVPs, can be described by the following general formula:

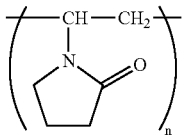

PVPs are prepared by free-radical polymerization of 1-vinylpyrrolidone. Standard commercial PVPs have molar masses in the range from about 2500 to 750 000 g/mol and are supplied as white, hygroscopic powders or as aqueous solutions.

Polyethylene oxides, shortened to PEOXs, are polyalkylene glycols of the general formula $$H—[O—CH_2—CH_2]_n—OH$$

which are prepared industrially by base-catalyzed polyaddition of ethylene oxide (oxirane) in systems comprising mostly small amounts of water with ethylene glycol as starter molecule. They have molar masses in the range from about 200 to 5 000 000 g/mol, corresponding to degrees of polymerization n of from about 5 to >100 000. Polyethylene oxides have an extremely low concentration of reactive hydroxy end groups and exhibit only weak glycol properties.

Gelatin is a polypeptide (molar mass: about 15 000 to >250 000 g/mol) which is obtained primarily by hydrolysis of the collagen present in animal skin and bones under acidic or alkaline conditions. The amino acid composition of the gelatin largely corresponds to that of the collagen from which it has been obtained and varies depending on its provenance. The use of gelatin as water-soluble shell material is extremely widespread in particular in pharmacy in the form of hard or soft gelatin capsules. Gelatin is not used widely in the form of films due to its high cost relative to the polymers specified above.

For the purposes of the present invention, preference is also given to water-based liquid dishwasher products whose packaging consists at least partially of water-soluble film of at least one polymer from the group consisting of starch and starch derivatives, cellulose and cellulose derivatives, in particular methylcellulose and mixtures thereof.

Starch is a homoglycan, where the glucose units are α-glycosidically joined. Starch is made up of two components of different molecular weight: from about 20 to 30% of straight-chain amylose (MW about 50 000 to 150 000) and 70 to 80% of branched-chain amylopectin (MW about 300 000 to 2 000 000). In addition, small amounts of lipids, phosphoric acid and cations are also present. Whereas the amylose forms long, helical, intertwined chains with about 300 to 12 000 glucose molecules as a result of the bond in the 1,4 position, the chain in the case of amylopectin branches after on average 25 glucose building blocks by a 1,6 bond to a branch-like structure with about 1500 to 1200 molecules of glucose. As well as pure starch, starch derivatives which are obtainable from starch by polymer-analogous reactions are also suitable for the preparation of water-soluble enclosures for the washing product, rinse product and cleaning product portions for the purposes of the present invention. Such chemically modified starches include, for example, products from esterifications or etherifications in which hydroxy hydrogen atoms have been substituted. However, starches in which the hydroxy groups have been replaced by functional groups which are not bonded via an oxygen atom can also be used as starch derivatives. The group of starch derivatives includes, for example, alkali metal starches, carboxymethylstarch (CMS), starch esters and starch ethers, and aminostarches.

Pure cellulose has the formal gross composition $(C_6H_{10}O_5)_n$ and, considered formally, is a β-1,4-polyacetal of cellobiose which, for its part, is constructed from two molecules of glucose. Suitable celluloses consist of about 500 to 5000 glucose units and, accordingly, have average molar masses of from 50 000 to 500 000. Cellulose-based disintegrants which can be used for the purposes of the present invention are also cellulose derivatives which are obtainable from cellulose by polymer-analogous reactions. Such chemically modified celluloses include, for example, products of esterifications and etherifications in which hydroxyl hydrogen atoms have been substituted. However, celluloses in which the hydroxy groups have been replaced by functional groups not attached via an oxygen atom may also be used as cellulose derivatives. The group of cellulose derivatives includes, for example, alkali metal celluloses, carboxymethylcellulose (CMC), cellulose esters and ethers, and aminocelluloses.

Preferred enclosures of at least partially water-soluble film comprise at least one polymer with a molar mass between 5000 and 500 000 g/mol, preferably between 7500 and 250 000 g/mol and in particular between 10 000 and 100 000 g/mol. The enclosure has different material thicknesses depending on the production process, preference being given to liquid aqueous machine dishwasher products according to the invention in which the wall thickness of the enclosure is 10 to 5000 μm, preferably 20 to 3000 μm, particularly preferably 25 to 2000 μm and in particular 100 to 1500 μm.

If film pouches are chosen as packaging, then the water-soluble film which forms the enclosure preferably has a thickness of from 1 to 300 μm, preferably from 2 to 200 μm, particularly preferably from 5 to 150 μm and in particular from 10 to 100 μm.

These water-soluble films can be produced by various production processes. In principle, blowing, calendering and casting processes should be mentioned. In a preferred process, the films are blown starting from a melt using air by means of a blowing mandrel to give a hose. In the calendering process, which is likewise a type of preferred production process, the raw materials plasticized by suitable additives are atomized to form the films. It may in particular be necessary here to follow the atomization with a drying step. In the casting process, which is likewise a type of preferred production process, an aqueous polymer preparation is placed onto a heatable drying roll, is optionally cooled following evaporation of the water and the film is removed in the form of a sheet. Where necessary, this sheet is additionally powdered before being removed or whilst being removed.

According to the invention, preference is given to an embodiment according to which the enclosure is water-soluble as a whole, i.e. dissolves completely when used in accordance with directions during machine washing if the conditions envisaged for dissolution are achieved. Particularly preferred completely water-soluble enclosures are e.g. capsules made of gelatin, advantageously made of soft gelatin, or pouches made of (optionally partially acetalized) PVAL or spheres of gelatin or (optionally partially acetalized) PVAL or of one or more organic and/or inorganic salts, preferably spheres of soft gelatin. An essential advantage of this embodiment is that the enclosure must at least partially dissolve within a practically relevant short time—as a non-limiting example a few seconds to 5 min—under exactly defined conditions in the cleaning liquor and thus, in accordance with the requirements, introduce the surrounded content, i.e. the cleaning-active material or two or more materials, into the liquor.

In another embodiment of the invention, which is likewise preferred on the basis of advantageous properties, the water-soluble enclosure includes sections which are less readily soluble or even insoluble in water or are soluble in water only at elevated temperature, and sections which are readily water-soluble or water-soluble at a low temperature. In other words, the enclosure consists not only of a uniform material having the same solubility in water in all areas, but of materials of differing solubility in water. In this connection, a distinction is to be made between areas of good solubility on the one hand and areas with less good solubility in water, with poor or even no solubility in water or areas in which the solubility in water achieves the desired value only at elevated temperature or only at a different pH or only at a changed electrolyte concentration. This may lead, when using the product in accordance with the directions under adjustable conditions, to certain areas of the enclosure dissolving, while other areas remain intact. An enclosure provided with pores or holes thus forms into which water and/or liquor can penetrate, dissolve washing-active, rinse-active or cleaning-active ingredients and flush them out of the enclosure. In the same way, enclosure systems in the form of multichamber pouches or in the form of hollow bodies arranged inside one another (e.g. spheres: "onion system") can also be provided. In this way, systems with controlled release of the washing-active, rinse-active or cleaning-active ingredients can be prepared.

For the formation of such systems, the invention is not subject to limitations. For example, enclosures can be provided in which a uniform polymer material includes small areas of incorporated compounds (for example of salts) which are more rapidly soluble in water than the polymer material. On the other hand, two or more polymer materials with different solubility in water can also be mixed (polymer blend), so that the polymer material which dissolves more quickly is more rapidly disintegrated under defined conditions by water or the liquor than the material which dissolves more slowly.

It corresponds to a particularly preferred embodiment of the invention that the areas of the enclosure which are less readily soluble in water or areas which are completely insoluble in water or areas which are soluble in water only at elevated temperature are areas made of a material which essentially corresponds chemically to that of the readily water-soluble areas or areas which are water-soluble at a lower temperature, but has a higher layer thickness and/or has a changed degree of polymerization of the same polymer and/or has a higher degree of crosslinking of the same polymer structure and/or has a higher degree of acetalization (in the case of PVAL, for example with saccharides, polysaccharides, such as starch) and/or has a content of water-insoluble salt components and/or has a content of a water-insoluble polymer. Even taking into consideration the fact that the enclosure does not dissolve completely, cleaning composition portions according to the invention can be prepared which have advantageous properties upon release of the water-based liquid dishwasher product into the particular liquor.

The water-soluble shell material is preferably transparent. For the purposes of this invention, transparency is understood as meaning that the transmittance within the visible spectrum of light (410 to 800 nm) is greater than 20%, preferably greater than 30%, most preferably greater than 40% and especially greater than 50%. Thus, as soon as a wavelength of the visible spectrum of light has a transmittance greater than 20%, it can be considered to be transparent for the purposes of the invention.

Water-based liquid dishwasher products according to the invention which are packaged in transparent enclosures or containers may comprise a stabilizer as an essential constituent. For the purposes of the invention, stabilizers are materials which protect the cleaning composition constituents in their water-soluble, transparent enclosures against decomposition or deactivation as a result of light irradiation. Antioxidants, UV absorbers and fluorescent dyes have proven particularly suitable.

For the purposes of the invention, particularly suitable stabilizers are the antioxidants. In order to prevent undesired changes to the formulations caused by light irradiation and thus free-radical decomposition, the formulations may comprise antioxidants. Antioxidants which may be used here are, for example, phenols, bisphenols and thiobisphenols substituted by sterically hindered groups. Further examples are propyl gallate, butylhydroxytoluene (BHT), butylhydroxyanisole (BHA), t-butylhydroquinone (TBHQ), tocopherol and the long-chain ($C_8$–$C_{22}$) esters of gallic acid, such as dodecyl gallate. Other classes of substance are aromatic amines, preferably secondary aromatic amines and substituted p-phenylenediamines, phosphorus compounds with trivalent phosphorus, such as phosphines, phosphites and phosphonites, citric acids and citric acid derivatives, such as isopropyl citrate, compounds containing enediol groups, so-called reductones, such as ascorbic acid and its derivatives, such as ascorbic acid palmitate, organosulfur compounds, such as the esters of 3,3'-thiodipropionic acid with $C_{1-18}$-alkanols, in particular $C_{10-18}$-alkanols, metal ion deactivators which are able to complex the autooxidation-catalyzing metal ions, such as, for example, copper, such as nitrilotriacetic acid and modifications thereof and admixtures. Antioxidants may be present in the formulations in amounts up to 35% by weight, preferably up to 25% by weight, particularly preferably from 0.01 to 20% by weight and in particular from 0.03 to 20% by weight.

A further class of stabilizers which can preferably be used are the UV absorbers. UV absorbers are able to improve the resistance of the formulation constituents to light. They are understood as meaning organic substances (light protection filters) which are able to absorb ultraviolet rays and emit the absorbed energy again in the form of long-wave radiation, e.g. heat. Compounds which have these desired properties are, for example, the compounds and derivatives of benzophenone with substituents in the 2 and/or 4 position which are effective as a result of radiation-free deactivation. Also suitable are, furthermore, substituted benzotriazoles, such as, for example, the water-soluble benzenesulfonic acid 3-(2H-benzotriazol-2-yl)-4-hydroxy-5-(methylpropyl) monosodium salt (Cibafast® H), acrylates which are substituted by phenyl in the 3 position (cinnamic acid derivatives), optionally by cyano groups in the 2 position, salicylates, organic Ni complexes and natural substances such as umbelliferone and endogenous urocanic acid. Biphenyl and, in particular, stilbene derivatives are of particular importance; these are available commercially as Tinosorb® FD or Tinosorb® FR ex Ciba. Examples of UV-B-absorbers are 3-benzylidenecamphor or 3-benzylidenenorcamphor and derivatives thereof, e.g. 3-(4-methylbenzylidene)camphor; 4-aminobenzoic acid derivatives, preferably 2-ethylhexyl 4-(dimethylamino)benzoate, 2-octyl 4-(dimethylamino)benzoate and amyl 4-(dimethylamino)benzoate; esters of cinnamic acid, preferably 2-ethylhexyl 4-methoxycinnamate, propyl 4-methoxycinnamate, isoamyl 4-methoxycinnamate, 2-ethylhexyl 2-cyano-3,3-phenylcinnamate (octocrylene); esters of salicylic acid, preferably 2-ethylhexyl salicylate, 4-isopropylbenzyl salicylate, homomenthyl salicylate; derivatives of benzophenone, preferably 2-hydroxy-4-methoxybenzophenone, 2-hydroxy-4-methoxy-4'-methylbenzophenone, 2,2'-dihydoxy-4-methoxybenzophenone; esters of benzalmalonic acid, preferably di-2-ethylhexyl 4-methoxybenzmalonate; triazine derivatives, such as, for example, 2,4,6-trianilino(p-carbo-2'-ethyl-1'-hexyloxy)-1,3,5-triazine and octyl triazone or dioctylbutamidotriazone (Uvasorb® HEB); propane-1,3-diones, such as, for example, 1-(4-tert-butylphenyl)-3-(4'-methoxyphenyl)propane-1,3-dione; ketotricyclo(5.2.1.0)decane derivatives. Also suitable are 2-phenylbenzimidazole-5-sulfonic acid and the alkali metal, alkaline earth metal, ammonium, alkylammonium, alkanolammonium and glucammonium salts thereof; sulfonic acid derivatives of benzophenones, preferably 2-hydroxy-4-methoxybenzophenone-5-sulfonic acid and its salts; sulfonic acid derivatives of 3-benzylidenecamphor, such as, for example, 4-(2-oxo-3-bornylidenemethyl)-benzenesulfonic acid and 2-methyl-5-(2-oxo-3-bornylidene)sulfonic acid and salts thereof.

Suitable typical UV-A filters are, in particular, derivatives of benzoylmethane, such as, for example, 1-(4'-tert-butylphenyl)-3-(4'-methoxyphenyl)propane-1,3-dione, 4-tert-butyl-4'-methoxydibenzoylmethane (Parsol 1789), 1-phenyl-3-( 4'-isopropylphenyl)propane-1,3-dione, and enamine compounds. The UV-A and UV-B filters can of course also be used in mixtures. As well as said soluble substances, insoluble light protection pigments are also suitable for this purpose, namely finely dispersed, preferably nanoized, metal oxides or salts. Examples of suitable metal oxides are, in particular, zinc oxide and titanium dioxide and also oxides of iron, zirconium, silicon, manganese, aluminum and cerium, and mixtures thereof. Salts which may be used are silicates (talc), barium sulfate or zinc stearate. The oxides and salts are already used in the form of pigments for skin care and skin-protecting emulsions and decorative cosmetics. The particles should here have an average diameter of less than 100 nm, preferably between 5 and 50 nm and in particular between 15 and 30 nm. They may have a spherical shape, although it is also possible to use particles which have an ellipsoidal shape or a shape which deviates in some other way from the spherical form. The pigments may also be surface-treated, i.e. hydrophilicized or hydrophobicized. Typical examples are coated titanium dioxides, such as, for example, titanium dioxide T 805 (Degussa) or Eusolex® T2000 (Merck). Suitable hydrophobic coating agents here are primarily silicones and, particularly preferably trialkoxyoctylsilanes or simethicones. Preference is given to using micronized zinc oxide.

UV absorbers may be present in the water-based liquid dishwasher products in amounts up to 5% by weight, preferably up to 3% by weight, particularly preferably from 0.01 to 2.0% by weight and in particular from 0.03 to 1% by weight.

A further class of stabilizers which can preferably be used are the fluorescent dyes. These include the 4,4'-diamino-2,2'-stilbenedisulfonic acids (flavone acids), 4,4'-distyrylbiphenyls, methylumbelliferones, cumarins, dihydroquinolinones, 1,3-diarylpyrazolines, naphthalimides, benzoxazole, benzisooxazole and benzimidazole systems, and pyrene derivatives substituted by heterocycles. Of particular importance in this connection are the sulfonic acid salts of diaminostilbene derivatives, and polymeric fluorescent substances, as disclosed in U.S. Pat. No. 5,082,578.

Fluorescent substances may be present in the formulations in amounts up to 5% by weight, preferably up to 1% by weight, particularly preferably from 0.01 to 0.5% by weight and in particular from 0.03 to 0.1% by weight.

In a preferred embodiment, the above-mentioned stabilizers are used in any desired mixtures. The stabilizers are used in amounts up to 40% by weight, preferably up to 30% by weight, particularly preferably from 0.01 to 20% by weight, in particular from 0.02 to 5% by weight.

As has already been mentioned above, water-based liquid dishwasher products according to the invention can be packaged so that the packaging is on the one hand water-soluble and on the other hand is tightly closed, i.e. is sealed from the environment. In this connection, two embodiments can be realized according to the invention:

Thus, it corresponds to a preferred embodiment of the invention that the enclosure(s) is/are sealed and comprises/comprise at least one anhydrous gas which does not react with the water-based liquid dishwasher product, more preferably comprises/comprise it in an amount such that the overall pressure within the sealed enclosure(s) is above the external pressure, even more preferably is at least 1 mbar above the external pressure. Very particularly preferred embodiments of these cleaning composition portions according to the invention comprise at least one anhydrous gas which does not react with the water-based liquid dishwasher product in an amount such that the overall pressure within the sealed enclosure(s) is at least 5 mbar, even more preferably at least 10 mbar, very particularly preferably in the range from 10 mbar to 50 mbar, above the external pressure. Very particularly in the case of the preferred embodiments with a total pressure within the enclosure(s) which is significantly above the external pressure, surprisingly, an ingress of moisture or water to the inside of the enclosure can be reduced or even reliably prevented. In connection with the present invention, "external pressure" is understood as meaning the pressure which prevails on the ambient side of the enclosure(s) and acts upon the outside of the enclosure(s) at the time of filling the enclosure with the particular at least one anhydrous gas.

According to the invention, the enclosure(s) can either comprise an anhydrous gas or can comprise two or more anhydrous gases. In practice, impaction of the enclosure(s) with a gas is preferred due to the reduced costs associated with it. For the purposes of the present invention, "anhydrous" is understood as meaning that the gas(es) are carefully dried prior to use in the cleaning composition portions according to the invention and thus comprise no or virtually no water upon use; a water content approaching zero is preferred here. The drying operation can take place by any method known to the person skilled in the art for this purpose. It is the aim that the gases contain as little water as possible which could react with the components in the cleaning composition portions and thus could lead to deterioration in the quality of such components sensitive to moisture or water. Preferred washing or cleaning composition portions according to the invention comprise, as gas(es), at least one anhydrous gas which is chosen from the group consisting of $N_2$, noble gas(es), $CO_2$, $N_2O$, $O_2$, $H_2$, air, gaseous hydrocarbons, very particularly $N_2$, which is available everywhere at low cost and can be completely "dried" by methods known per se. Said gases are advantageously inert to the components of the washing-active preparation and are therefore also sometimes referred to as "inert gases" for the purposes of the present invention.

According to a further, likewise preferred embodiment of the cleaning composition portion according to the invention, the enclosure(s) is/are sealed and contain at least one substance which, upon reaction with water, releases a gas which does not react with the washing-active preparation(s) in an amount such that the overall pressure within the sealed enclosure(s) increases. Those cleaning composition portions in which the at least one substance present in the enclosure(s) releases, upon reaction with water, the at least one gas in an amount such that the overall pressure within the sealed enclosure(s) increases by at least 1 mbar above the external pressure, preferably by at least 5 mbar, particularly preferably is higher by a value in the range from 5 to 50 mbar than the external pressure are particularly advantageous. This embodiment is particularly advantageous since its preparation is much more simple than the embodiment in which the gas is present in the sealed enclosure since only the at least one substance has to be present which, upon contact with moisture/water, generates at least one gas within the sealed enclosure. Furthermore, any moisture which has penetrated into the enclosure is immediately absorbed and converted by the substance capable of reaction with water and thus is no longer available for a deterioration in the quality of the components of the washing-active preparation. Also conceivable are mixed forms of the cleaning composition preparation in which, from the start, both (at least) one anhydrous gas is in the sealed enclosure, and a substance capable of reacting with water is present. By means of this embodiment it is possible, in a particularly good and efficient manner, to prevent the deterioration in the components of the product according to the invention as a result of the ingress of moisture or water.

According to a preferred embodiment of the invention, the substance which, with water, releases a gas is a constituent of the washing-active preparation and—even more preferred, is a hygroscopic substance which is compatible with the components of the washing-active preparation(s). This has the advantage, inter alia, that this/these substance(s) immediately absorbs moisture or water when it has managed to ingress into the inside of the enclosure, with the formation of a gas, which increases the internal pressure within the enclosure to a value above the atmospheric pressure and thus, surprisingly, makes it difficult or impossible for further moisture or further water to enter.

Examples of such substances are, without being understood as a limitation, substances chosen from the group consisting of substances containing bonded hydrogen peroxide, substances containing —O—O groups, substances containing O—C—O groups, hydrides and carbides, further preference being given to a substance which is chosen from the group consisting of percarbonates (particularly preferably sodium percarbonate), persulfate, perborate, peracids, $M_AM_BH_4$, in which $M_A$ is an alkali metal (particularly preferably Li or Na) (for example $LiAlH_4$, $NaBH_4$, $NaAlH_4$) and $M_B$ is B or Al, or $M^1{}_2C_2$ or $M^{II}C_2$, in which $M^1$ is a monovalent metal and $M^{II}$ is a divalent metal (for example $CaC_2$).

According to the invention, preference is given to cleaning composition portions in which the anhydrous gas present in the enclosure(s) with which the enclosure(s) are directly impacted is chosen from the group consisting of $N_2$, noble gas(es), $CO_2$, $N_2O$, $O_2$, $H_2$, air, gaseous hydrocarbons or mixtures thereof. The preferred gas—or at least one of the preferred gases— is $N_2$, namely due to the fact that nitrogen is available everywhere and obtainable at low cost and can be readily dried with customary agents or can be dried and stockpiled.

According to the invention, preference is likewise given to those cleaning composition portions in which the at least one gas formed within the enclosure by the substance which is reactive with water or moisture is chosen from the group consisting of $CO_2$, $N_2$, $H_2$, $O_2$, gaseous hydrocarbons, such as, for example, methane, ethane, propane, or a mixture of two or more of said gases. Said gases are advantageously inert toward the components of the washing-active preparation and are therefore also sometimes referred to as "inert gases" for the purposes of the present invention.

What is claimed is:

1. A liquid aqueous machine dishwasher product comprising:

a) 20 to 50% by weight of one or more water-soluble phosphates;

b) 0.1 to 70% by weight of copolymers of:

i) one or more unsaturated carboxylic acids;

ii) one or more monomers containing sulfonic acid groups; and iii) optionally one or more further ionic or nonionogenic monomers; and c) 5 to 30% by weight of one or more nonionic surfactants, wherein the pH of a 1% strength by weight solution of the composition in distilled water is between 7 and 11.

2. The liquid aqueous machine dishwasher product of claim 1, comprising, as a water-soluble builder, one or more phosphates, alkali metal phosphates, or mixtures thereof.

3. The liquid aqueous machine dishwasher product of claim 2, wherein the phosphates comprise either or both of pentasodium or pentapotassium phosphate.

4. The liquid aqueous machine dishwasher product of claim 2, comprising the water-soluble builder(s) in amounts of from 22.5 to 45% by weight, based on the total composition.

5. The liquid aqueous machine dishwasher product of claim 4, comprising the water-soluble builder(s) in amounts of from 25 to 40% by weight, based on the total composition.

6. The liquid aqueous machine dishwasher product of claim 5, comprising the water-soluble builder(s) in amounts of from 27.5 to 35% by weight, based on the total composition.

7. The machine dishwasher product claim 1, comprising, as ingredient b), one or more copolymers which contain structural units of the formulae III and/or IV and/or V and/or VI and/or VII and/or VIII $$—[CH_2—CHCOOH]_m—[CH_2—CHC(O)—Y—SO_3H]_p— \quad (III),$$

$$—[CH_2—C(CH_3)COOH]_m—[CH_2—CHC(O)—Y—SO_3H]_p— \quad (IV),$$

$$—[CH_2—CHCOOH]_m—[CH_2—C(CH_3)C(O)—Y—SO_3H]_p— \quad (V),$$

$$—[CH_2—C(CH_3)COOH]_m—[CH_2—C(CH_3)C(O)—Y—SO_3H]_p— \quad (VI),$$

$$—[HOOCCH—CHCOOH]_m—[CH_2—CHC(O)—Y—SO_3H]_p— \quad (VII),$$

$$—[HOOCCH—CHCOOH]_m—[CH_2—C(CH_3)C(O)O—Y—SO_3H]_p— \quad (VIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms.

8. The machine dishwasher product claim 7, where spacer Y is $—O—(CH_2)_n—$ where n=1 to 4, $—O—(C_6H_4)—$, $—NH—C(CH_3)_2$, or $—NH—CH(CH_2CH_3)—$.

9. The machine dishwasher product of claim 1, comprising the sulfonated copolymer(s) in amounts of from 0.25 to 50% by weight.

10. The machine dishwasher product of claim 9, comprising the sulfonated copolymer(s) in amounts of from 0.5 to 35% by weight.

11. The machine dishwasher product of claim 10, comprising the sulfonated copolymer(s) in amounts of from 0.75 to 20% by weight.

12. The machine dishwasher product of claim 11, comprising the sulfonated copolymer(s) in amounts of from 1 to 15% by weight.

13. The machine dishwasher product of claim 1, comprising 5 to 25% by weight of the nonionic surfactant(s).

14. The machine dishwasher product of claim 13, comprising 6 to 22.5% by weight of the nonionic surfactant(s).

15. The machine dishwasher product of claim 14, comprising 7.5 to 20% by weight of the nonionic surfactant(s).

16. The machine dishwasher product of claim 15, comprising 8 to 17.5% by weight of the nonionic surfactant(s).

17. The machine dishwasher product of claim 1, wherein it additionally comprises 5 to 50% by weight of nonaqueous solvents.

18. The machine dishwasher product of claim 17, wherein it additionally comprises 7.5 to 40% by weight of one or more nonaqueous solvents.

19. The machine dishwasher product of claim 18, wherein it additionally comprises 10 to 30% by weight of one or more nonaqueous solvents.

20. The machine dishwasher product of claim 19, wherein the one or more nonaqueous solvents are selected from the group consisting of polyethylene glycols and polypropylene glycols, glycerol, glycerol carbonate, triacetin, ethylene glycol, propylene glycol, propylene carbonate, hexylene glycol, ethanol, n-propanol, isopropanol, and mixtures thereof.

21. The machine dishwasher product of claim 1, wherein it additionally comprises one or more substances selected from the group consisting of acidifying agents, chelate completing agents, deposit-inhibiting polymers, and combinations thereof.

22. The machine dishwasher product of claim 1, wherein it additionally comprises 0.01 to 5% by weight of one or more polymeric thickeners.

23. The machine dishwasher product of claim 22, comprising 0.02 to 4% by weight of the polymeric thickener(s).

24. The machine dishwasher product of claim 23, comprising 0.05 to 3% by weight of the polymeric thickener(s).

25. The machine dishwasher product of claim 24, comprising 0.1 to 1.5% by weight of the polymeric thickener(s).

26. The machine dishwasher product of claim 22, wherein the polymeric thickener(s) are selected from the group consisting of polyurethanes or of modified polyacrylates.

27. The machine dishwasher product of claim 26, wherein the polymeric thickener(s) comprise one or more thickeners of the formula IX

IX

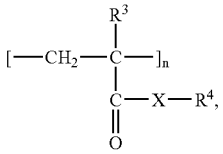

in which $R^3$ is H or a branched or unbranched $C_{1-4}$-alk(en)yl radical, X is N—$R^5$ or O, $R^4$ is an optionally alkoxylated branched or unbranched, optionally substituted $C_{8-22}$-alk(en)yl radical, $R^5$ is H or $R^4$, and n is a natural number.

28. The machine dishwasher product of claim 1, wherein it additionally comprises enzymes and/or enzyme preparations.

29. The machine dishwasher product of claim 28, wherein the enzymes and/or enzyme preparations comprise solid and/or liquid protease preparations and/or amylase preparations.

30. The machine dishwasher product of claim 28, comprising from 1 to 5% by weight of the enzymes and/or enzyme preparations.

31. The machine dishwasher product of claim 30, comprising from 1.5 to 4.5 of the enzymes and/or enzyme preparations.

32. The machine dishwasher product of claim 28, comprising 2 to 4% by weight of the enzymes and/or enzyme preparations.

33. The machine dishwasher product of claim 1, having a viscosity of from 500 to 5000 mPas.

34. The machine dishwasher product of claim 33, having a viscosity of from 1000 to 4000 mPas.

35. The machine dishwasher product of claim 1, having a viscosity of from 1300 to 3000 mPas.

36. The machine dishwasher product of claim 1, wherein the pH of a 1% strength by weight solution of the composition in distilled water is between 8 and 10.

37. The machine dishwasher product of claim 36, wherein the pH of a 1% strength by weight solution of the composition in distilled water is between 8.5 and 9.5.

38. The machine dishwasher product of claim 1, wherein it additionally comprises one or more redox-active substances selected from the group consisting of manganese, titanium, zirconium, hafnium, vanadium, cobalt and cerium salts and/or complexes and mixtures thereof.

39. The machine dishwasher product of claim 38, wherein the metals are present in one or more of the oxidation states II, III, IV, V or VI.

40. The machine dishwasher product of claim 38, wherein the metal salts and/or metal complexes are present in an amount of from 0.05 to 6% by weight.

41. The machine dishwasher product of claim 40, wherein the metal salts and/or metal complexes are present in an amount of from 0.2 to 2.5% by weight.

42. The machine dishwasher product of claim 38, wherein the metal salts and/or metal complexes are selected from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TlF_6$, $K_2ZrF_6$, $CoSO_4$, $Co(NO_3)_2$, $Ce(NO_3)_3$, and mixtures thereof.

43. The machine dishwasher product of claim 1, wherein it additionally comprises one or more magnesium and/or zinc salts and/or magnesium and/or zinc complexes.

44. The machine dishwasher product of claim 43, comprising one or more magnesium and/or zinc salt(s) at least of one monomeric and/or polymeric organic acid.

45. The machine dishwasher product of claim 44, comprising insoluble zinc salts having a particle size below 1.7 millimeters.

46. The machine dishwasher product of claim 1, wherein it is packaged in portions in a water-soluble enclosure.

47. The machine dishwasher product of claim 46, wherein the enclosure comprises one or more materials selected from the group consisting of polymers containing acrylic acid, polyacrylamides, oxazoline polymers, polystyrenesulfonates, polyurethanes, polyesters, polyethers, and mixtures thereof.

48. The machine dishwasher product of claim 46, wherein the enclosure has a wall thickness of from 10 to 5000 μm.

49. The machine dishwasher product of claim 48, wherein the enclosure has a wall thickness of from 20 to 3000 μm.

50. The machine dishwasher product of claim 49, wherein the enclosure has a wall thickness of from 25 to 2000 μm.

51. The machine dishwasher product of claim 50, wherein the enclosure has a wall thickness of from 100 to 1500 μm.

52. The machine dishwasher product of claim 46, wherein the water-soluble enclosure comprises one or more materials selected from the group consisting of (optionally acetalized) polyvinyl alcohol (PVAL), polyvinylpyrrolidone, polyethylene oxide, gelatin, cellulose, derivatives thereof, and mixtures thereof.

53. The machine dishwasher product of claim 46, wherein the enclosure comprises a polyvinyl alcohol whose degree of hydrolysis is 70 to 100 mol %.

54. The machine dishwasher product of claim 53, wherein the enclosure comprises a polyvinyl alcohol whose degree of hydrolysis is 80 to 90 mol %.

55. The machine dishwasher product of claim 54, wherein the enclosure comprises a polyvinyl alcohol whose degree of hydrolysis is 81 to 89 mol %.

56. The machine dishwasher product of claim 55, wherein the enclosure comprises a polyvinyl alcohol whose degree of hydrolysis is 82 to 88 mol %.

57. The machine dishwasher product of claim 53, wherein the polyvinyl alcohol has a molecular weight in the range from 10 000 to 100 000 $gmol^{-1}$.

58. The machine dishwasher product of claim 57, wherein the polyvinyl alcohol has a molecular weight in the range from 11 000 to 90 000 $gmol^{-1}$.

59. The machine dishwasher product of claim 58, wherein the polyvinyl alcohol has a molecular weight in the range from 12 000 to 80 000 $gmol^{-1}$.

60. The machine dishwasher product of claim 59, wherein the polyvinyl alcohol has a molecular weight in the range from 13 000 to 70 000 $gmol^{-1}$.

* * * * *